US005728497A

United States Patent [19]

Kato et al.

[11] Patent Number: 5,728,497

[45] Date of Patent: Mar. 17, 1998

[54] METHOD FOR PREPARATION OF WATERLESS LITHOGRAPHIC PRINTING PLATE BY ELECTROPHOTOGRAPHIC PROCESS

[75] Inventors: Eiichi Kato; Akio Oda, both of Shizuoka, Japan

[73] Assignee: Fuji Photo Film Co., Ltd., Kanagawa, Japan

[21] Appl. No.: 634,289

[22] Filed: Apr. 18, 1996

[30] Foreign Application Priority Data

Apr. 21, 1995 [JP] Japan ..... 7-097093

[51] Int. Cl.[6] ..... G03G 13/28

[52] U.S. Cl. ..... 430/49; 430/97; 430/117; 101/465

[58] Field of Search ..... 430/49, 97, 117, 430/256, 303, 258; 101/465, 466, 467

[56] References Cited

U.S. PATENT DOCUMENTS

| | | | |
|---|---|---|---|
| 3,907,562 | 9/1975 | Crystal | 430/303 |
| 3,999,481 | 12/1976 | Sankus | 101/451 |
| 5,455,134 | 10/1995 | Dankert | 430/49 |

FOREIGN PATENT DOCUMENTS

| | | |
|---|---|---|
| 49-121602 | 11/1974 | Japan . |
| 3118254 | 5/1991 | Japan . |

OTHER PUBLICATIONS

Patent & Trademark Office English–Language Translation of JP 3–118154 (Pub May 1991).

*Primary Examiner*—Janis L. Dote

*Attorney, Agent, or Firm*—McAulay Fisher Nissen Goldberg & Kiel, LLP

[57] ABSTRACT

A method for preparation of a waterless lithographic printing plate by an electrophotographic process comprising forming a non-fixing toner image on a surface of an electrophotographic light-sensitive element comprising an electrically conductive support having provided thereon a photoconductive layer by an electrophotographic process, providing a non-tacky resin layer having adhesion to the surface of electrophotographic light-sensitive element larger than adhesion between the toner image and the surface of electrophotographic light-sensitive element on the whole surface of electrophotographic light-sensitive element bearing the toner image, and selectively removing the non-tacky resin layer provided on the toner image.

11 Claims, No Drawings

METHOD FOR PREPARATION OF WATERLESS LITHOGRAPHIC PRINTING PLATE BY ELECTROPHOTOGRAPHIC PROCESS

FIELD OF THE INVENTION

The present invention relates to a method for preparation of a waterless lithographic printing plate by an electrophotographic process. More particularly, it relates to a method for preparation of a waterless lithographic printing plate including an electrophotographic toner image-forming step to which method a scanning exposure using a laser beam having a low power can be applied and which provides a lithographic printing plate excellent in image qualities and printing durability.

BACKGROUND OF THE INVENTION

In general, lithographic printing involves a step of applying water to a hydrophilic non-image areas of a printing plate to prevent adherence of oily printing ink and a step of feeding oily printing ink to oleophilic image areas of the printing plate. However, maintaining of the delicate balance between the amount of water applied to the plate and the amount of ink fed to the plate is difficult and needs a skilled worker.

In order to overcome these problems of conventional lithography, waterless lithographic printing plates capable of printing in the absence of dampening water have been provided. Waterless lithographic printing plates have oil repellant areas and oleophilic areas. Oily ink is applied to the plate and adheres only to the oleophilic areas and an ink image thus formed on the plate is transferred to paper. One method practically used comprises imagewise exposing to light a printing plate material having, in sequence, a silicone rubber layer and a light-sensitive layer composed of a photosensitive resin to make difference in adhesion between the silicone rubber layer and the light-sensitive layer in the exposed area from the non-exposed areas and removing the imaging areas by a wet development processing to prepare a lithographic printing plate. This method requires contact imagewise exposure using a light source having a short wavelength and a high power due to low-sensitivity of the printing plate material and the wet development processing. Therefore, this method has problems in simplicity, rapidness and labor-saving and is very difficult to apply to the preparation of lithographic printing plate accepting a recent image-forming system using a digital signal, i.e. a digital direct printing plate.

A system has been commercialized by Heiderberg Co., Ltd. wherein a printing plate material comprising a heat-sensitive layer containing a substance capable of converting radiation into heat and a silicon layer provided thereon is subjected to scanning exposure by a laser beam corresponding to a digital signal to destroy the silicon layer together with the heat-sensitive layer using the heat generated in the exposed portion, followed by removing these layers in the exposed portion by a dry development processing thereby providing a waterless printing plate.

According to the system, writing by a laser beam using a heat mode and a dry development processing are employed. However, a laser writing device of high power is necessary because of low sensitivity of the recording material which leads to increase in a size of apparatus, a period of plate-making and a cost of the system.

JP-A-47-19305 (the term "JP-A" as used herein means an "unexamined published Japanese patent application"), JP-A-49-19904, JP-A-59-125752 and JP-A-62-160466 each discloses a method capable of image-forming simply in an apparatus of a small size using an electrophotographic light-sensitive element suitable for scanning exposure by a semiconductor laser beam of a low power. On the electrophotographic light-sensitive element is provided a silicon layer and then an oleophilic toner image is formed thereon by an electrophotographic process to prepare a waterless printing plate.

However, adhesion of the toner image portion to the silicon layer is poor in the printing plate and the image portion is apt to be damaged by tack of ink supplied which results in the occurrence of image failure. Thus a printing durability of the plate is very low.

in order to improve a printing durability there have been proposed methods for increasing adhesion between the toner image portion and the silicon layer. For example, there are a method wherein a un-hardened silicone rubber layer is provided and after the formation of toner image, the silicone rubber is hardened as described, for example, in JP-A-50-53110 and JP-A-52-105003, and a method using a reactive group-containing silicon rubber layer as described, for example, in JP-A-52-29305, JP-A-56-83750 and JP-A-57-178893. However, these methods are still insufficient in the adhesion for the practical purpose.

JP-A-49-121602 discloses a method comprising forming an image composed of dry toner on a paper support by a PPC copying machine such as a laser printer using a semiconductor of low power or a printer of heat-sensitive transfer, providing a silicon layer on the whole surface of the paper, hardening the silicon layer and then selectively removing the silicon layer on the image portion upon a wet development processing using a solvent to prepare a printing plate.

Also, JP-A-3-118154 discloses a method comprising forming imagewise a light-absorbing layer or a non-adhesive layer using dry toner on a support for lithographic printing plate by a PPC copying machine such as a laser printer using a semiconductor of low power or a printer of heat-sensitive transfer, providing a silicon layer on the whole surface of the support, hardening the silicon layer and then selectively removing the silicon layer on the image portion upon a dry development processing using heat or mechanical means to prepare a printing plate.

According to these methods described in JP-A-49-121602 and JP-A-3-118154, poor adhesion of toner image to a silicon layer occurred in the printing plate prepared by forming the toner image on the silicon layer as described hereinbefore can be solved. Further, a simple dry process can be used for removing the silicon layer on the image portion in the method described in JP-A-3-118154.

These methods, however, include a transfer process of toner image from a light-sensitive element to a support for lithographic printing plate. Thus, degradation of image quality due to the transfer process occurs even in an electrophotographic system which is excellent in reproducibility of image. This is particularly troublesome in case of forming a highly accurate image.

Further, since adhesion between the silicon layer and the support in the non-image portion is insufficient and releasability of the silicon layer depends on a conversion rate of radiation to heat of a dye or pigment employed, a difference of adhesion between the silicon layer and the support in the non-image portion from adhesion between the image portion and the support is small in fact. Accordingly, it is difficult to selectively remove the silicon layer in fine image regions, and thus faithful reproduction of image to the original is not achieved. Moreover, because of the insufficient adhesion between the silicon layer and the support in the non-image portion, a strength of non-image portion of the printing plate obtained is not satisfactory and its printing durability is insufficient.

Recently, a printing system providing prints of highly accurate full color image in a simple, rapid and laborsaving manner including edition in a workstation and digital image processing has been highly desired. However, such a desire cannot be answered by the techniques describe about.

SUMMARY OF THE INVENTION

Therefore, an object of the present invention is to provide a method for preparation of a waterless lithographic printing plate by an electrophotographic process which is suitable for scanning exposure system using a laser beam of a low power and which provides a lithographic printing plate excellent in image qualities and printing durability in a simple, rapid and laborsaving manner.

Another object of the present invention is to provide a method for preparation of a waterless lithographic printing plate by an electrophotographic process which is capable of faithfully reproducing a highly accurate image.

A further object of the present invention is to provide a method for preparation of a waterless lithographic printing plate by an electrophotographic process in which an image portion is removable by a dry process and which provides a highly accurate image in a stable manner even when a condition of removing step is fluctuated.

Other objects of the present invention will become apparent from the following description.

It has been found that the above described objects of the present invention are accomplished by a method for preparation of a waterless lithographic printing plate by an electrophotographic process comprising forming a non-fixing toner image on a surface of an electrophotographic light-sensitive element comprising an electrically conductive support having provided thereon a photoconductive layer by an electrophotographic process, providing a non-tacky resin layer having adhesion to the surface of electrophotographic light-sensitive element larger than adhesion between the toner image and the surface of electrophotographic light-sensitive element on the whole surface of electrophotographic light-sensitive element bearing the toner image, and selectively removing the non-tacky resin layer provided on the toner image.

DETAILED DESCRIPTION OF THE INVENTION

The method of the present invention is characterized in that the non-fixing toner layer is formed on an electrophotographic light-sensitive element and then the non-tacky resin layer having adhesion to the surface of electrophotographic light-sensitive element larger than adhesion between the toner image and the surface of electrophotographic light-sensitive element is provided.

According to the method, the non-tacky resin layer provided on the toner image can be selectively and easily removed. Since the adhesion between the surface of light-sensitive element and the non-tacky resin layer is larger than the adhesion between the surface of light-sensitive element and the toner image, even fine image regions are easily removed. Accordingly, the lithographic printing plate obtained has excellent image qualities and faithful reproduction of highly accurate image can be achieved. Further, due to the large adhesion between the surface of light-sensitive element and the non-tacky resin layer, a film strength of the non-image portion is sufficiently maintained and thus, excellent printing durability is obtained. Since the image portion is easily removed and superfluous steps and devices are unnecessary, rapidness and laborsaving of the image formation and downsizing of an apparatus for the method are realizable.

In a preferred embodiment of the present invention, the non-tacky resin layer on the toner image is removable by a dry process, whereby the non-tacky resin layer provided on the toner image is more selectively and easily removed.

According to another preferred embodiment of the present invention, the surface of electrophotographic light-sensitive element used has a reactive group capable of forming a chemical bond with the non-tacky resin layer at the interface thereof. A chemical reaction occurs at least at the interface between the electrophotographic light-sensitive element which acts as support of a lithographic printing plate afterward and the non-tacky resin layer in the non-image portion to form a crosslinked structure and the adhesion between the non-tacky resin layer and the support is more increased and maintained. As a result, image reproducibility and printing durability are further improved.

The adhesion between the surface of electrophotographic light-sensitive element and the non-tacky resin layer is controlled to be larger than that between the toner image and the electrophotographic light-sensitive element in accordance with the method of the present invention.

More specifically, a difference between a force necessary for releasing the non-tacky resin layer from the surface of electrophotographic light-sensitive element in the non-image portion and a force necessary for removing the non-tacky resin layer from the surface of electrophotographic light-sensitive layer in the image portion is preferably not less than 180 gram·force (g·f), more preferably not less than 250 g·f, and particularly preferably not less than 295 g·f.

Moreover, the force necessary for releasing the non-tacky resin layer from the surface of electrophotographic light-sensitive element in the non-image portion is preferably not less than 200 g·f and, on the other hand, the force necessary for removing the non-tacky resin layer from the surface of electrophotographic light-sensitive element in the image portion is preferably not more than 20 g·f. More preferably, the force necessary for releasing in the non-image portion is not less than 300 g·f and the force necessary for removing in the image portion is not more than 5 g·f.

Making such a substantial difference in the adhesion of non-tacky resin layer between the non-image portion and the image portion, the non-tacky resin layer on the toner image is selectively removed in the image portion without damaging the non-tacky resin layer in the non-image portion to form a pattern of the non-tacky resin layer on the electrophotographic light-sensitive element. Also, the removing of non-tacky resin layer in the image portion is performed by the application of mechanical power including, for example, peel-apart or brushing.

The measurement of releasing force is conducted according to JIS Z 0237-1980 8.3.1. 180 *Degrees Peeling Method* with the following modifications:

(i) As a test plate of the non-image portion, an electrophotographic light-sensitive element having a non-tacky resin layer provided thereon is used. As a test plate of the image portion, an electrophotographic light-sensitive element subjected to toner development and having the non-tacky resin layer provided thereon is used.

(ii) As a test piece, a silicon adhesive tape of 25 mm in width (#851A manufactured by Minnesota Mining and Manufacturing Co.) is used.

(iii) A peeling rate is 25 mm/min using a constant rate of traverse type tensile testing machine.

Specifically, the test piece is laid its adhesive face downward on the test plate and a roller is reciprocate one stroke at a rate of approximately 300 mm/min upon the test piece for pressure sticking. Within 20 to 40 minutes after the sticking with pressure, a part of the stuck portion is peeled approximately 25 mm in length and then peeled continuously at the rate of 25 mm/min using the constant rate of traverse type tensile testing machine. The strength is read at an interval of approximately 5 mm in length of peeling, and eventually read 4 times. The test is conducted on three test pieces. The mean value is determined from 12 measured values for three test pieces and the resulting mean value is converted in terms of 10 nun in width.

In order to provide the difference in peeling force or adhesion between the non-image portion and the image portion as described above, the following means are illustrated, but the present invention is not to be limited thereto.

I. Making the non-tacky resin layer of a specific composition.

i) Incorporating a specific component into the non-tacky resin layer.

ii) Incorporating a resin for adhesion into the non-tacky resin layer in addition to the non-tacky resin.

iii) Forming the non-tacky resin layer having a stratified structure composed of an adhesive layer and an ink repellant layer to divide the functions of non-tacky resin layer.

ii. Forming a chemical bond between the surface of electrophotographic light-sensitive element and the non-tacky resin layer.

III. Not-fixing a toner image or forming the toner image using toner resin grains having a specific composition.

These means may be employed individually or in a combination of two or more thereof. These means will be described in more detail hereinafter.

Now, the non-tacky resin layer used in the present invention will be described in detail below.

The non-tacky resin layer which can be used in the present invention is a resin layer having adhesion to a surface of an electrophotographic light-sensitive element larger than adhesion between the surface of electrophotographic light-sensitive element and a toner image formed thereon, forming an ink repellant surface in order to prevent ink from sticking to the surface at the time of printing after the preparation of a waterless lithographic printing plate and having a good antiabrasion property. The adhesion of non-tacky resin layer to the surface of electrophotographic light-sensitive element is preferably not less than 200 g·f as described above.

The surface of non-tacky resin layer preferably has a surface energy of not more than 30 erg·cm$^{-1}$ for oil repellency. To control the surface energy in such a range prevent the sticking of ink and provides clear prints free from stain in the non-image portion. The surface energy of non-tacky resin layer is preferably not more than 28 erg·cm$^{-1}$, more preferably not more than 25 erg·cm$^{-1}$, and particularly preferably in a range of from 25 erg·cm$^{-1}$ to 15 erg·cm$^{-1}$.

One example for controlling the surface energy of non-tacky resin layer in the range described above is to incorporate a non-tacky resin, for example, a silicone resin or a fluorinated resin into the non-tacky resin layer.

The fluorinated resin includes resins mainly composed of polymer component containing a moiety having a fluorine atom.

The moiety having a fluorine atom contained in the resin includes that incorporated into the main chain of polymer and that contained as a substituent in the side chain of polymer.

The fluorine atom-containing moieties include monovalent or divalent organic residues, for example, —$C_nF_{2n+1}$ (wherein n represents an integer of from 1 to 22), —$CFH_2$, —$(CF_2)_nCF_2H$ (wherein n represents an integer of from 1 to 17), —$CF_2$— and —CFH—.

The fluorine atom-containing organic residue may be composed of a combination thereof. In such a case, they may be combined either directly or via a linking group. The linking groups include divalent organic residues, for example, divalent aliphatic groups, divalent aromatic groups, and combinations thereof, which may or may not contain a bonding group, e.g., $$-O-,\ -S-,\ -\overset{d^1}{\overset{|}{N}}-,\ -CO-,\ -SO-,\ -SO_2-,\ -COO-,$$

$$-OCO,\ -CONHCO-,\ -NHCONH-,\ -\overset{d^1}{\overset{|}{CON}}-,\ \text{and}\ -SO_2\overset{d^1}{\overset{|}{N}}-,$$

wherein $d^1$ represents an alkyl group having from 1 to 3 carbon atoms.

The polymer component having a fluorine atom-containing moiety is preferably present in a range of from 80 to 100 parts by weight per 100 parts by weight of the total polymer component of the fluorinated resin.

The fluorinated resin may contain a curable functional group. The content of curable functional group in the resin is preferably from 1 to 20% by weight. The curable functional group will be described in greater detail with respect to the silicone resin hereinafter.

A weight average molecular weight of the fluorinated resin is preferably from $5\times10^3$ to $1\times10^6$, and more preferably from $2\times10^4$ to $5\times10^5$.

The silicone resin includes resins mainly composed of polymer component containing a moiety having a silicon atom. Specific examples of the silicone resins used in the present invention include polymers mainly composed of an organo siloxane repeating unit represented by the general formula (I) shown below.

$$-\left(\begin{array}{c} R^1 \\ | \\ Si-O \\ | \\ R^2 \end{array}\right)- \qquad (I)$$

wherein $R^1$ and $R^2$, which may be the same or different, each represents an aliphatic or aromatic hydrocarbon group or a heterocyclic group.

The aliphatic or aromatic hydrocarbon group represented by $R^1$ or $R^2$ includes preferably a straight chain or branched chain alkyl group having from 1 to 18 carbon atoms which may be substituted (e.g., methyl, ethyl, propyl, butyl, pentyl, hexyl, heptyl, octyl, nonyl decyl, dodecyl, tridecyl, tetradecyl, hexadecyl, octadecyl, 2-fluoroethyl, trifluoromethyl, 2-chloroethyl , 2-bromodethyl , 2-cyanoethyl , 2-methoxycarbonylethyl, 2-methoxyethyl, 3-bromopropyl, 2-methoxycarbonylethyl, 2,3-dimethoxypropyl, —$(CH_2)_pC_nF_{2n+1}$ (wherein p represents an integer of 1 or 2; and n represents an integer of from 1 to 12), or —$(CH_2)_p$—$(CF_2)_m$—R' (wherein p represents an integer of 1 or 2; m represents an integer of from 1 to 12 and R' represents —$CFHCF_3$ or —$CFHCF_2H$)), an alkenyl group having from 4 to 18 carbon atoms which may be substituted (e.g., 2-methyl-1-propenyl, 2-butenyl, 2-pentenyl, 3-methyl-2-pentenyl, 1-pentenyl, 1-hexenyl, 2-hexenyl, 4-methyl-2-hexenyl, decenyl, dodecenyl, tridecenyl, hexadecenyl, octadecenyl, or linolyl), an aralkyl group having from 7 to 12 carbon atoms which may be substituted (e.g., benzyl, phenethyl, 3-phenylpropyl, naphthylmethyl, 2-naphthylethyl, chlorobenzyl, bromobenzyl, methylbenzyl, ethylbenzyl , methoxybenzyl, dimethylbenzyl, or dimethoxybenzyl ), an alicyclic group having from 5 to 8 carbon atoms which may be substituted ( e.g., cyclopentyl , cyclohexyl, 2-cyclohexylethyl , 2-cyclopentylethyl, polyfluorohexyl, methylcyclohexyl, or methoxycyclohexyl), or an aromatic group having from 6 to 12 carbon atoms which may be substituted (e.g., phenyl, naphthyl, tolyl, xylyl, propylphenyl, butylphenyl, octylphenyl, dodecylphenyl, methoxyphenyl, ethoxyphenyl, butoxyphenyl, fluorophenyl, chlorophenyl, difluorophenyl, bromophenyl, cyanophenyl, acetylphenyl, methoxycarbonylphenyl, ethoxycarbonylphenyl, butoxycarbonylphenyl, acetamidophenyl, propionamidophenyl, or trifluoromethylphenyl).

The heterocyclic group represented by $R^1$ or $R^2$ includes preferably a 5-membered or 6-membered heterocyclic ring containing at least one hetero atom selected from nitrogen atom, an oxygen atom and a sulfur atom which may be substituted and may form a condensed ring. Suitable examples of heterocyclic ring include pyrane, furan, thiophene, morpholine, pycrole, thiazole, oxazole, pyridine, piperidine, pyrrolidone, benzothiazole, benzoxazole, quinoline, or tetrahydrofuran.

It is preferred that both $R^1$ and $R^2$ are methyl groups.

Of the silicone resins, those having not less than 60% by weight, based on the total organo siloxane unit, of a dimethylsiloxane unit, i.e., $R^1$ and $R^2$ each represents a methyl group in the general formula (I) are preferred. The content of dimethylsiloxane unit in the resin is more preferably not less than 75% by weight based on the total organic siloxane unit. By using such a silicone resin, the non-tacky resin layer exhibits excellent ink repellency and thus the occurence of background stain is prevented.

As the specific component for increasing the adhesion between the non-tacky resin layer and the surface of electrophotographic light-sensitive element in the non-image portion as described in (I)-(i) above, another organo siloxane unit represented by the general formula (I) wherein $R^1$ and $R^2$ each represents a substituted alkyl group (e.g. an alkyl group substituted with a halogen atom or a cyano group), or a substituted or unsubstituted aralkyl, aromatic or heterocyclic group is employed.

Further, the hydrocarbon group or heterocyclic group represented by $R^1$ or $R^2$ containing a polar group, for example, a carboxy group, a hydroxy group, a mercapto group, a phospho group or an amido group, or a divalent connecting group, for example, a ureido group (—NHCONH—), a thioether group (—S—) or a urethane group (—NHCO—) is also employed.

The content of an organo siloxane unit having such a substituent is preferably less than 40% by weight, more preferably less than 25% by weight based on the total organo siloxane unit.

The dimethylsiloxane unit preferred as the ink repellant component and the other organo siloxane unit for increasing adhesion are preferably present in the above described range and form any of a random copolymer, a block copolymer and a star copolymer without a particular limitation. Using such a resin in the non-tacky resin layer, it is possible to maintain the good ink repellant surface and increase the adhesion to the surface of electrophotographic light-sensitive element.

A weight average molecular weight of the silicone resin is preferably from $5\times10^3$ to $1\times10^6$, and more preferably from $2\times10^4$ to $5\times10^5$.

The non-tacky resin used in the present invention includes a resin containing both a fluorine atom and a silicon atom.

The silicone resin is preferably employed as the non-tacky resin in the method of the present invention.

It is preferred that the non-tacky resin layer containing the non-tacky resin used in the present invention is cured to form a crosslinked structure therein prior to the step of selective removing the non-tacky resin layer provided on the toner image. As a result, a mechanical strength of the non-tacky resin layer is increased and the non-image portion is not damaged during the step of removing the toner image portion. Further, its resistance against a mechanical pressure at printing is improved and printing durability is increased.

In order to form a cured non-tacky resin layer on the electrophotographic light-sensitive element bearing the toner image, a method of providing the resin layer containing a previously cured non-tacky resin (method (1)) or a method of providing the non-tacky resin layer and then curing it (method (2)) can be employed.

Any conventionally known method for curing a resin to form a crosslinked structure can be employed to conduct the above described methods (1) and (2). The curing method is explained referring to a silicone resin as an example in the following description.

For example, a self-crosslinking method of a silicone resin, a method of curing a silicone resin using a crosslinking agent or curing agent, or a combination thereof can be employed.

A reaction mode of the crosslinking reaction of the resin includes any conventionally known chemical reaction to form a bond. Also, a combination of such a reaction can be used.

Specific examples of the reaction mode include the following reactions i) to iv):

i) Crosslinking with an ion bond formed by a chelate reaction between an acidic group (e.g., a carboxy group, a sulfo group, or a phosphono group) contained in the resin and a poly-valent metal ion including a cation of polyvalent metal (e.g., Ca, Mg, Ba, Al, Zn, Fe, Sn, Zr or Ti).

ii) Crosslinking with a chemical bond formed by an addition reaction, a substitution reaction or an elimination reaction between organic reactive groups (for example, a hydroxy group, a thiol group, a halogen atom (e.g., a chlorine atom, a bromine atom or iodine atom), a carboxy group, an acid anhydride group, an amino group, an isocyanate group, a protected isocyanate group (a blocked isocyanate group), an acid halide group, an epoxy group, an imino group, a formyl group, a diazo group or an azido group).

iii) Self-crosslinking with a self-coupling group (for example, —$CONHCH_2OR_1'$ (wherein $R_1'$ represents a hydrogen atom or an alkyl group).

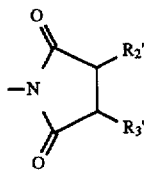

(wherein $R_2'$ and $R_3'$, which may be the same or different, each represents a hydrogen atom or an alkyl group, or $R_2'$ and $R_3'$ may combine each other to form a 5-membered or 6-membered alicyclic ring), a cinnamoyl group or $—Si(R_4')_l(OR_5')_m$ (wherein $R_4'$ represents an alkyl group, an alkenyl group or an aryl group; $R_5'$ represents an alkyl group, l represents an integer of from 0 to 2; and m represents an integer of from 1 to 3, provided that l+m=3)).

iv) Crosslinking by an addition polymerization reaction of a polymerizable double bond group or a polymerizable triple bond group. Suitable examples of the polymerizable double bond group include $CH_2=C(p)COO—$, $C(CH_3)H=CHCO—$, $CH_2=C(CH_2COOH)COO—$, $CH_2=C(p)CONH—$, $CH_2=C(p)CONHCOO—$, $CH_2=C(p)CONHCONH—$, $C(CH_3)H=CHCONH—$, $CH_2=CHCO—$, $CH_2=CH(CH_2)_nOCO—$, $CH_2=CHO—$, $CH_2=CHC_6H_4—$ and $CH_2=CH—S—$ wherein p represents a hydrogen atom or a methyl group; and n represents an integer of from 0 to 3. Suitable examples of the polymerizable triple bond group include these groups described above but replacing the double bond with a triple bond.

The reactive group appropriately selected is introduced into the silicon resin through a linking group, if desired. Specifically, (1) either $R^1$,$R^2$ or both per se of the organo siloxane unit represented by the general formula (I) is replaced with the reactive group, or either $R^1$, $R^2$ or both of the organo siloxane unit includes the reactive group, (2) a repeating unit of the silicon resin other than the organo siloxane unit includes the reactive group, or (3) the silicon resin includes the reactive group at the terminal of its polymer chain.

Further, conventionally known specific cross-linking reactions of organo siloxane polymer are effectively employed. these methods are described in details, for example, in Kunio Ito (ed.), *Silicone Handbook*, Nikkan Kogyo Shinbunsha (1990) and Makoto Kumade and Tadashi Wada (supervised), *Saishin Silicone Gijutu-Kaihatsu to Oyo-*, C.M.C. (1986). Specific examples of the reactive group for the reactions include the followings.

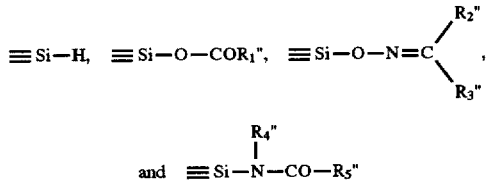

(wherein $R_1''$, $R_2''$, $R_3''$, $R_4''$ or $R_5''$ each represents an alkyl group).

The units containing curable reactive group are present at random in the polymer chain of silicone resin with organo siloxane units represented by the general formula (I) which exhibit ink repellency in case of a random copolymer. The silicone resin also can be a so-called block copolymer wherein a block for ink repellency and a block for curing are bonded. The forms of block include a graft type block, an AB type block (including an ABA type block) and a star type block.

The content of the block for ink repellent in the block copolymer is preferably not less than 30% by weight, and more preferably not less than 50% by weight based on the total polymer component of the silicone resin.

The crosslinking agents or curing agents capable of forming a crosslinked structure in the silicone resin include low molecular weight compounds, oligomers and polymers which are conventionally known as heat-, photo- or moisture-curable compounds. These compounds can be employed individually or in a combination of two or more thereof.

Suitable examples of the crosslinking agent or curing agent used in the present invention include those described, for example, in Shinzo Yamashita and Tosuke Kaneko (ed.), *Kakyozai Handbook*, Taiseisha (1981), Kobunshi Gakkai (ed.), *Kobunshi Data Handbook* (*Kiso-hen*), Baifukan (1986), Tsuyoshi Endo, *Netsukokasei Kobunshi no Seimitsuka*, C.M.C. (1986), Yuji Harasaki, *Saishin Binder Gijutsu Binran*, Ch. II-1, Sogo Gijutsu Center (1985), Takayuki Otsu, *Acryl Jushi no Gosei.Sekkei to Shinyoto Kaihatsu*, Chubu Kei-ei Kaihatsu Center Shuppanbu (1985), and *Silicon Handbook*, supra.

Specific examples of suitable crosslinking agents or curing agents include organo silane compounds (e.g., vinyltrimethoxy silane, vinyltriethoxysilane, γ-glycidoxypropyltrimethoxysilane, γ-mercaptopropyltriethoxysilane, γ-aminopropyltriethoxysilane), vinyltrichlorosilane, vinyltris(t-butyl-peroxido)silane, γ-(β-aminoethyl) aminoproplytrimethoxysilane, γ-chloropropyltrimethoxysilane, and silane coupling agents), polyisocyanate compounds (e.g., toluylene deesocyanate, diphenylmethane diisocyanate, triphenylmethane triisocyanate, polymethylenepolyphenyl isocyanate, hexamethylene diisocyante, isophorone diisocyanate, and polymeric polyisocyanates), blocked polyisocyanate compounds in which isocyanate groups of the above described polyisocyanate compounds are protected (examples of compounds used for the protection of isocyanate group including alcohols, β-diketones, β-kstoesters, and aminos), polyol compounds (e.g., 1,4-butanediol, polyoxypropylene glycol, polyoxyethylene glycols, and 1,1,1-trimethylolpropane), polyamine compounds (e.g., ethylenediamine, γ-hydroxypropylated ethylenediamin, phenylenediamine, hexamethylenediamine, N-aminoethylpiperazine, and modified aliphatic polyamines), titanate coupling compounds (e.g., titanium tetrabutoxide, titanium tetrapropoxide, and isopropyltristearoyl titanate), aluminum coupling compounds (e.g., aluminum butylate, aluminum acetylacetate, aluminum oxide octate, and aluminum tris(acetylacetate)), polyepoxy-containing compounds and epoxy resins (e.g., the compounds as described in Hiroshi Kakiuchi (ed.), *Shin-Epoxy Jushi*, Shokodo (1985) and Kuniyuki Hashimoto (ed.), *Epoxy Jushi*, Nikkan Kogyo Shinbunsha (1969)), melamine resins (e.g., the compounds as described in Ichiro Miwa and Hideo Matsunaga (ed.), *Urea.Melamine Jushi*, Nikkan Kogyo Shinbunsha (1969)), and poly(meth)acrylate compounds (e.g., the compounds as described in Shin Okawara, Takeo Saegusa, and Toshinobu Higashimura (ed.), *Oligomer*, Kodansha (1976), and Eizo Omori, *Kinosei Acryl-kei Jushi*, Techno System (1985)).

Specific examples of the polymerizable functional groups which are contained in the polyfunctional monomer or oligomer (the monomer will sometimes be referred to as a polyfunctional monomer (d)) having two or more polymerizable functional groups include $CH_2=CH—CH_2—$, $CH_2=CH—CO—O—$, $CH_2=CH—$, $CH_2=C(CH_3)—CO—O—$, $CH(CH_3)=CH—CO—O—$, $CH_2=CH—CONH—$, $CH_2=C(CH_3)—CONH—$, $CH(CH_3)=CH—CONH—$, $CH_2=CH—O—CO—$, $CH_2=C(CH_3)—O—CO—$, $CH_2=CH—CH_2—O—CO—$, $CH_2=CH—NHCO—$, $CH_2=CH—CH_2—NHCO—$, $CH_2=CH—SO_2—$, $CH_2=CH—CO—$, $CH_2=CH—O—$, and $CH_2=CH—S—$. The two or more polymerizable functional groups present in the polyfunctional monomer or oligomer may be the same or different.

Specific examples of the monomer or oligomer having the same two or more polymerizable functional groups include styrene derivatives (e.g., divinylbenzene and trivinylbenzene); methacrylic, acrylic or crotonic acid esters, vinyl ethers or allyl ethers of polyhydric alcohols (e.g., ethylene glycol, diethylene glycol, triethylene glycol, polyethylene glycol #200, #400 or #600, 1,3-butylene glycol, neopentyl glycol, dipropylene glycol, polypropylene glycol, trimethylolpropane, trimethylolethane, and pentaerythritol) or polyhydric phenols (e.g., hydroquinone, resorcin, catechol, and derivatives thereof); vinyl esters, allyl esters, vinyl amides, or allyl amides of dibasic acids (e.g., malonic acid, succinic acid, glutaric acid, adipic acid, pimelic acid, maleic acid, phthalic acid, and itaconic acid); and condensation products of polyamines (e.g., ethylenediamine, 1,3-propylenediamine, and 1,4-butylenediamine) and vinyl-containing carboxylic acids (e.g., methacrylic acid, acrylic acid, crotonic acid, and allylacetic acid).

Specific examples of the monomer or oligomer having two or more different polymerizable functional groups include reaction products between vinyl-containing carboxylic acids (e.g., methacrylic acid, acrylic acid, methacryloylacetic acid, acryloylacetic acid, methacryloylpropionic acid, acryloylpropionic acid, itaconyloylacetic acid, itaconyloylpropionic acid, and a carboxylic acid anhydride) and alcohols or amines, vinyl-containing ester derivatives or amide derivatives (e.g., vinyl methacrylate, vinyl acrylate, vinyl itaconate, allyl methacrylate, allyl acrylate, allyl itaconate, vinyl methacryloylacetate, vinyl methacryloylpropionate, allyl methacryloylpropionate, vinyloxycarbonylmethyl methacrylate, vinyloxycarbonylmethyloxycarbonylethytene acrylate, N-allylacrylamide, N-allylmethacrylamide, N-allylitaconamide, and methacryloylpropionic acid allylamide) and condensation products between amino alcohols (e.g., aminoethanol, 1-aminopropanol, 1-aminobutanol, 1-aminohexanol, and 2-aminobutanol) and vinyl-containing carboxylic acids.

If desired, a reaction accelerator may be used together with the resin for accelerating the cross-linking reaction in the non-tacky resin layer.

The reaction accelerators which may be used for the crosslinking reaction forming a chemical bond between functional groups include organic acids (e.g., acetic acid, propionic acid, butyric acid, benzenesulfonic acid, and p-toluenesulfonic acid), phenols (e.g., phenol, chlorophenol, nitrophenol, cyanophenol, bromophenol, naphthol, and dichlorophenol), organometallic compounds (e.g., zirconium acetylacetonate, zirconium acetylacetone, cobalt acetylacetonate, and dibutoxytin dilaurate), dithiocarbamic acid compounds (e.g., diethyldithiocarbamic acid salts), thiuram disulfide compounds (e.g., tetramethylthiuram disulfide), and carboxylic acid anhydrides (e.g., phthalic anhydride, maleic anhydride, succinic anhydride, butylsuccinic anhydride, benzophenone-3,3',4,4'-tetracarboxylic acid dianhydride, and trimellitic anhydride).

The reaction accelerators which may be used for the crosslinking reaction involving ploymerization include heat-polymerization initiators, such as peroxides and azobis compounds, and photo-polymerization initiators and sensitizers, such as those described, for example, in P. Walker, N. J. Webers, et al., *J. Phot. Sci.*, vol. 18, page 150 (1970) and Katsumi Tokumaru and Shin Okawara (ed.), *Zokanzai*, Kodansha (1987) and including carbonyl compounds,.organic sulfur compounds, azine compounds and azo compounds.

In order to accelerate curing or control reaction of the silicone resin, a platinum catalyst, methylvinyltetrasiloxane, or an acetylenealcohol is used.

The condition of curing is appropriately selected depending on each elements to be employed.

Heat-curing is conducted in a conventional manner. For example, the heat treatment is carried out at 60° C. to 150° C. for 5 to 120 minutes. The condition of the heat treatment may be made milder by using the above-described reaction accelerator in combination.

Curing of the resin containing a photocurable functional group can be carried out by incorporating a step of irradiation of actinic ray into the method. The actinic rays to be used include visible light, ultraviolet light, far ultraviolet light, electron beam, X-ray, γ-ray, and α-ray, with ultraviolet light being preferred. Actinic rays having a wavelength range of from 310 to 500 nm are more preferred. In general, a low-, high- or ultrahigh-pressure mercury lamp or a halogen lamp is employed as a light source. Usually, the irradiation treatment can be sufficiently performed at a distance of from 5 cm to 50 cm for 10 seconds to 10 minutes.

The content of non-tacky resin in the non-tacky resin layer is preferably from 60 to 100% by weight, and more preferably from 80 to 100% by weight based on the total weight of composition of the resin layer.

The non-tacky resin layer used in the present invention can contain other resins in a range which does not adversely affect the ink repellency together with the non-tacky resin in order to increase the adhesion between the non-tacky resin layer and the surface of electrophotographic light-sensitive element.

As the resin for increasing adhesion, conventionally known various kinds of having a softening point of not less than 30° C. may be employed. Suitable examples of these resins include olefin polymers or copolymers, vinyl chloride copolymers, vinylidene chloride copolymers, vinyl alkanoate polymers or copolymers, allyl alkanoate polymers or copolymers, polymers or copolymers of styrene or derivatives thereof, butadiene-styrene copolymer, isoprene-styrene copolymers, butadiene-unsaturated carboxylic ester copolymers, acrylonitrile copolymers, methacrylonitrile copolymers, alkyl vinyl ether copolymers, acrylic ester polymers or copolymers, methacrylic ester polymers or copolymers, styrene-acrylic ester copolymers, styrenemethacrylic ester copolymers, itaconic diester polymers or copolymers, maleic anhydride copolymers, acrylamide copolymers, methacrylamide copolymers, polycarbonate resins, ketone resins, polyester resins, amide resins, alkyl-modified nylon resins, hydroxy- or carboxy-modified polyester resins, butyral resins, polyvinyl acetal resins, cyclized rubber-methacrylic ester copolymers, cyclized rubber-acrylic ester copolymers, cellulose acetate resins, urethane resins, copolymers containing a heterocyclic ring which does not contain a nitrogen atom (the heterocyclic ring including, for example, furan, tetrahydrofuran, thiophene, dioxane, dioxofuran, lactone, benzofuran, benzothiophene and 1,3-dioxetane rings) and epoxy resins.

Of the resins for increasing the adhesion, vinyl alkanoate polymers or copolymers, acrylic resins, methacrylic resins, vinyl chloride resins, cellulose acetate resins, urethane resins and epoxy resins are particularly preferred.

The content of resin for increasing the adhesion in the non-tacky resin layer is preferably not more than 80% by weight, and more preferably not more than 60% by weight based on the total weight of resins employed.

The resin for increasing the adhesion may contain a heat-, photo- or moisture-curable reactive group as describe above.

In order to achieve the good ink repellency and the good adhesion in the non-tacky resin layer, the resin for increasing the adhesion is made compatible with the non-tacky resin using the method described, for example, in Gijutujoho Kyokai (ed.), *Kobunshi no Soyoka to Hyokaqijutsu*, (1992) and Seiichi Nakahama et al, Kobunshi Gakkai (ed.), *Kokino Polymer Alloy*, Maruzen (1991)

In the layer composed of a mixture of the non-tacky resin and the resin for increasing the adhesion, the characteristic of the non-tacky resin in that it tends to concentrated near the surface of the layer can be utilized. In such a case, it is preferred, as one of the resins for increasing the adhesion, to further employ a copolymer containing a block composed of a polymer component having a fluorine atom and/or a silicon atom same as in the non-tacky resin in a small amount in order to increase the interaction between the resins and to increase the cohesion in the layer.

The non-tacky resin layer used in the present invention may have a stratified structure as described above. For example, a double-layer structure wherein a resin layer having good adhesion (adhesive function layer) is provided adjacent to the electrophotographic light-sensitive element and thereon a layer of the non-tacky resin having good ink repellency is employed.

Maintenance of adhesion between the adhesive function layer and the layer of non-tacky resin having good ink repellency can be performed by adding a copolymer containing a block composed of a polymer component compatible with the resin for increasing the adhesion and a block composed of a polymer component compatible with the non-tacky resin preferably in the adhesive function layer.

Now, the method for preparation of a waterless lithographic printing plate will be described in detail below.

The construction and materials used for the electrophotographic light-sensitive element according to the present invention are not particularly limited and any of those conventionally known can be employed.

Suitable examples of electrophotographic light-sensitive element used are described, for example, in Denshishashin Gakkai (ed.), *Denshishashin Gijutsu no Kiso to Oyo*, Corona (1988), Hiroshi Kokado (ed.), *Saikin no Kododen Zairyo to Kankotai no Kaihatsu.Jitsuyoka*, Nippon Kagaku Joho (1985), Takaharu Shibata and Jiro ishiwatari, *Kobunshi*, Vol. 17, p. 278 (1968), Harumi Miyamoto and Hidehiko Takei, *Imaging*, Vol. 1973, No. 8, Denshishashin Gakkai (ed.), *Denshishashinyo Yukikankotai no Genjo Symposium* (preprint) (1985), R. M. Schaffert , *Electrophotography*, Forcal Press, London (1980), S. W. Ing, M. D. Tabak and W. E. Haas, *Electrophotography Fourth international Conference*, SPSE (1983), isao Shinohara, Hidetoshi Tsuchida and Hideaki Kusakawa (ed.), *Kirokuzairyo to Kankoseijushi*, Gakkai Shuppan Center (1979), and Hiroshi Kokado, *Kagaku to Kogyo*, Vol. 39, No. 3, p. 161 (1986).

A photoconductive layer for the electrophotographic light-sensitive element which can be used includes a single layer made of a photoconductive compound itself and a photoconductive layer comprising a binder resin having dispersed therein a photoconductive compound. The dispersed type photoconductive layer may have a single layer structure or a laminated structure. The photoconductive compounds used in the present invention may be inorganic compounds or organic compounds.

Inorganic photoconductive compounds used in the present invention include those conventionally known and having no apprehension of safety, for example, zinc oxide, titanium oxide, zinc sulfide, amorphous silicon, and lead sulfide. These compounds are used together with a binder resin to form a photoconductive layer, or they are used alone to form a photoconductive layer by vacuum deposition or spattering.

Where an inorganic photoconductive compound, e.g., zinc oxide or titanium oxide, is used, a binder resin is usually used in an amount of from 10 to 100 parts by weight, and preferably from 15 to 40 parts by weight, per 100 parts by weight of the inorganic photoconductive compound.

Organic photoconductive compounds used may be selected from conventionally known compounds. Suitable photoconductive layers containing an organic photoconductive compound include (i) a layer comprising an organic photoconductive compound, a sensitizing dye, and a binder resin, and (ii) a layer comprising a charge generating agent, a charge transporting agent, and a binder resin or a double-layered structure containing a charge generating agent and a charge transporting agent in separate layers.

The photoconductive layer of the electrophotographic light-sensitive element according to the present invention may have any of the above-described structure.

In the latter case, an organic photoconductive compound is employed as the charge transporting agent.

The organic photoconductive compounds which may be used in the present invention include, for example, triazole derivatives, oxadiazole derivatives, imidazole derivatives, polyarylalkane derivatives, pyrazoline derivatives, pyrazolone derivatives, arylamine derivatives, azulenium salt derivatives, amino-substituted chalcone derivatives, N,N-bicarbazyl derivatives, oxazole derivatives, styrylanthracene derivatives, fluorenone derivatives, hydrazone derivatives, benzidine derivatives, stilbene derivatives, polyvinylcarbazole and derivatives thereof, vinyl polymers such as polyvinylpyrene, polyvinylanthracene, poly-2-vinyl-4-(4'-dimethylaminophenyl)-5-phenyloxazole and poly-3-vinyl-N-ethylcarbazole, polymers such as polyacenaphthylene, polyindene and an acenaphthylene-styrene copolymer, triphenylmethane polymers, and condensed resins such as pyrene-formaldehyde resin, bromopyrene-formaldehyde resin and ethylcarbazole-formaldehyde resin.

The organic photoconductive compounds which can be used in the present invention are not limited to the above-described compounds, and any of known organic photoconductive compounds may be employed in the present invention. The organic photoconductive compounds may be used either individually or in combination of two or more thereof.

The charge generating agents which can be used in the photoconductive layer include various conventionally known charge generating agents, either organic or inorganic, such as selenium, selenium-tellurium, cadmium sulfide, zinc oxide, and organic pigments described below. The charge generating agent is appropriately selected to have spectral sensitivity suitable for a wavelength of a light source employed.

The organic pigments used include azo pigments (including monoazo, bisazo, trisazo, and tetrazo pigments), metal-free or metallized phthalocyanine pigments, perylene pigments, indigo or thioindigo derivatives, quinacridone pigments, polycyclic quinone pigments, bisbenzimidazole pigments, squarylium salt pigments, and azulenium salt pigments.

These charge generating agents may be used either individually or in combination of two or more thereof.

The charge transporting agents used in the photoconductive layer include those described for the organic photoconductive compounds above. The charge transporting agent is appropriately selected so as to suite the charge generating agent to be employed in combination.

With respect to a mixing ratio of the organic photoconductive compound and a binder resin, particuarly the upper limit of the organic photoconductive compound is determined depending on the compatibility between these materials. The organic photoconductive compound, if added in an amount over the upper limit, may undergo undesirable crystallization. The lower the content of the organic photoconductive compound, the lower the electrophotographic sensitivity. Accordingly, it is desirable to use the organic photoconductive compound in an amount as much as possible within such a range that crystallization does not occur. In general, 5 to 120 parts by weight, preferably from 10 to 100 parts by weight, of the organic photoconductive compound is used per 100 parts by weight of the total binder resin.

Binder resins which can be used in the light-sensitive element according to the present invention include those for conventionally known electrophotographic light-sensitive elements. A weight average molecular weight of the binder resin is preferably from $5\times10^3$ to $1\times10^6$, and more preferably from $2\times10^4$ to $5\times10^5$. A glass transition point of the binder resin is preferably from −40° to 200° C., and more preferably from −10° to 140° C.

Suitable examples of the binder resin used are described, for example, in Koichi Nakamura (ed.), *Kioku Zairyoyo Binder no Jissai Gijutsu*, Ch. 10, C.M.C. (1985), Tsuyoshi Endo, *Netsukokasei Kobunshi no Seimitsuka*, C.M.C. (1986), Yuji Harasaki, *Saishin Binder Gijutsu Binran*, Ch. II-1, Sogo Gijutsu Center (1985), Takayuki Otsu, *Acryl Jushi no Gosei-Sekkei to Shinyoto Kaihatsu*, Chubu Kei-ei Kaihatsu Center Shuppanbu (1985), Eizo Omori, *Kinosei Acryl-Kei Jushi*, Techno System (1985), D. Tatt and S. C. Heidecker, *Tappi*, Vol. 49, No. 10, p. 439 (1966), E. S. Baltazzi and R. G. Blanchlotte, et al., *Photo. Sci. Eng.*, Vol. 16, No. 5, p. 354 (1972), and Nguyen Chank Keh, Isamu Shimizu and Eiichi Inoue, *Denshi Shashin Gakkaishi*, Vol. 18, No. 2, p. 22 (1980), in addition to the literature references mentioned with respect to the electrophotographic light-sensitive element above.

Specific examples of binder resins used include olefin polymers or copolymers, vinyl chloride copolymers, vinytidene chloride copolymers, vinyl alkanoate polymers or copolymers, allyl alkanoate polymers or copolymers, polymers or copolymers of styrene or derivatives thereof, butadiene-styrene copolymers, isoprene-styrene copolymers, butadiene-unsaturated carboxylic ester copolymers, acrylonitrile copolymers, methacrylonitrile copolymers, alkyl vinyl ether copolymers, acrylic ester polymers or copolymers, methacrylic ester polymers or copolymers, styreneacrylic ester copolymers, styrene-methacrylic ester copolymers, itaconic diester polymers or copolymers, maleic anhydride copolymers, acrylamide copolymers, methacrylamide copolymers, polycarbonate resins, ketone resins, polyester resins, amide resins, hydroxy- or carboxy-modified polyester resins, butyral resins, polyvinyl acetal resins, cyclized rubber-methacrylic ester copolymers, cyclized rubber-acrylic ester copolymers, copolymers containing a heterocyclic ring which does not contain a nitrogen atom (the heterocyclic ring including, for example, furan, tetrahydrofuran, thiophene, dioxane, dioxofuran, lactone, benzofuran, benzothiophene and 1,3-dioxetane rings), and epoxy resins.

Further, the electrostatic characteristics of photoconductive layer are improved by using as the binder resin a resin having a relatively low molecular weight (e.g., a weight average molecular weight of from $10^3$ to $10^4$) and containing an acidic group such as a carboxy group, a sulfo group or a phosphono group. Suitable examples of such a resin are described, for example, in JP-A-64-70761, JP-A-2-67563, JP-A-3-81948 and JP-A-3-249659.

Moreover, in order to maintain a relatively stable performance even when ambient conditions are widely fluctuated, a specific medium to high molecular weight resin is employed as the binder resin. For instance, JP-A-3-29954, JP-A-3-77954, JP-A-3-92861 and JP-A-3-53257 disclose a resin of graft type copolymer having an acidic group bonded at the terminal of the graft portion or a resin of graft type copolymer containing acidic groups in the graft portion. Also, JP-A-3-206464 and JP-A-3-223762 discloses a resin of graft type copolymer having a graft portion formed from an AB block copolymer comprising an A block containing acidic groups and a B block containing no acidic group.

In a case of using these resins, the photoconductive substance is uniformly dispersed to form a photoconductive layer having good smoothness. Further, excellent electrostatic characteristics can be maintained even when ambient conditions are fluctuated or when a scanning exposure system using a semiconductor laser beam is utilized for the image exposure.

Depending on the kind of a light source for exposure, for example, visible light or semiconductor laser beam, various dyes may be used as spectral sensitizers. The sensitizing dyes used include carbonium dyes, diphenylmethane dyes, triphenylmethane dyes, xanthene dyes, phthalein dyes, polymethine dyes (including oxonol dyes, merocyanine dyes, cyanine dyes, rhodacyanine dyes, and styryl dyes), and phthalocyanine dyes (including metallized dyes), as described, for example, in *Denshishashin*, Vol. 12, p. 9 (1973), *Yuki Gosei Kagaku*, Vol. 24, No. 11, p. 1010 (1966), Harumi Miyamoto and Hidehiko Takei, *Imaging*, Vol. 1973, No. 8, p. 12, C. J. Young et al., *RCA Review*, Vol. 15, p. 469 (1954), Kohei Kiyota et al., *Denkitsushin Gakkai Ronbunshi*, Vol. J 63-C, No. 2, p. 97 (1980), Yuji Harasaki et al., *Kogyo Kagaku Zasshi*, Vol. 66, p. 78 and 188 (1963), Tadaaki Tani, *Nihon Shashin Gakkaishi*, Vol. 35, p. 208 (1972), *Research Disclosure*, No. 216, pp. 117–118 (1982), and F. M. Hamer, *The Cyanine Dyes and Related Compounds*, in addition to the literature references mentioned with respect to the electrophotographic light-sensitive element above.

The electrophotographic light-sensitive element of the present invention is excellent in that the characteristics thereof hardly vary with the combined use of various sensitizing dyes.

If desired, the electrophotographic light-sensitive element may further contain various additives conventionally known for electrophotographic light-sensitive elements. The additives include chemical sensitizers for increasing electrophotographic sensitivity and plasticizers or surface active agents for improving film properties.

Suitable examples of the chemical sensitizers include electron attracting compounds such as a halogen, benzoquinone, chloranil, fluoranil, bromanil, dinitrobenzene, anthraquinone, 2,5-dichlorobenzoquinone, nitrophenol, tetrachlorophthalic anhydride, phthalic anhydride, maleic anhydride, N-hydroxymaleimide, N-hydroxyphthalimide, 2,3-dichloro-5,6-dicyanobenzoquinone, dinitrofluorenone, trinitrofluorenone, tetracyanoethylene, nitrobenzoic acid, and dinitrobenzoic acid; and polyarylalkane compounds, hindered phenol compounds and p-phenylenediamine compounds as described in the literature references cited in Hiroshi Kokado, et al., *Saikin no Kododen Zairyo to Kankotai no Kaihatsu-Jitsuyoka*, Chs. 4 to 6, Nippon Kagaku Joho (1986). In addition, the compounds as described in JP-A-58-65439, JP-A-58-102239, JP-A-58-129439, and JP-A-62-71965 may also be used.

Suitable examples of the plasticizers, which may be added for improving flexibility of a photoconductive layer, include dimethyl phthalate, dibutyl phthalate, dioctyl phthalate, diphenyl phthalate, triphenyl phosphate, diisobutyl adipate, dimethyl sebacate, dibutyl sebacate, butyl laurate, methyl phthalyl glycolate, and dimethyl glycol phthalate. The plasticizer can be added in an amount that does not impair electrostatic characteristics of the photoconductive layer.

The amount of the additive to be added is not particularly limited, but ordinarily ranges from 0.001 to 2.0 parts by weight per 100 parts by weight of the photoconductive substance.

The photoconductive layer usually has a thickness of from 1 to 100 μm, and preferably from 10 to 50 μm.

Where a photoconductive layer functions as a charge generating layer of a laminated type light-sensitive element composed of a charge generating layer and a charge transporting layer, the charge generating layer has a thickness of from 0.01 to 5 μm, and preferably from 0.05 to 2 μm.

The photoconductive layer of the present invention can be provided on a conventionally known support. in general, a support for an electrophotographic light-sensitive layer is preferably electrically conductive. The electrically conductive support which can be used includes a substrate (e.g., a metal plate, paper, or a plastic sheet) having been rendered conductive by impregnation with a low-resistant substance, a substrate whose back side (opposite to the light-sensitive layer side) is rendered conductive and further having coated thereon at least one layer for, for example, curling prevention, the above-described substrate having formed on the surface thereof a water-resistant adhesive layer, the above-described substrate having on the surface thereof at least one precoat layer, and a paper substrate laminated with a plastic film on which aluminum, etc. has been vacuum deposited.

Specific examples of the conductive substrate and materials for rendering non-conductive substrates electrically conductive are described, for example, in Yukio Sakamoto, *Denshishashin*, Vol. 14, No. 1, pp. 2–11 (1975), Hiroyuki Moriga, *Nyumon Tokushushi no Kagaku*, Kobunshi Kankokai (1975), and M. F. Hoover, *J. Macromol. Sci. Chem.*, Vol. A-4, No. 6, pp. 1327–1417 (1970).

In accordance with a preferred embodiment of the present invention, the surface of electrophotographic light-sensitive element is chemically bonded to the non-tacky resin layer. Specifically, the surface portion of electrophotographic light-sensitive element has a reactive group capable of forming a chemical bond with a reactive group present in a resin constituting the non-tacky resin layer by the action of radiation, heat or moisture to form a crosslinked structure between the electrophotographic light-sensitive element and the non-tacky resin layer. For this purpose, a resin containing the reactive group is incorporated into the uppermost layer of electrophotographic light-sensitive element.

The reactive groups used are same as the curable reactive groups which may be present in the non-tacky resin described above. The reactive group is employed individually or in combination of two or more thereof. The usable group is appropriately selected so as to react with the reactive group in the non-tacky resin to form a chemical bond.

The content of a polymer component containing the reactive group is at least 1% by weight, preferably not less than 5% by weight based on the total polymer component.

It is more preferred to employ a resin having a polymer component containing a fluorine atom and/or silicon atom in addition to the reactive group in the uppermost layer of electrophotographic light-sensitive element. The fluorine atom and/or silicon atom may be present in a polymer component containing the reactive group or in other polymer component.

Such a type of the reactive group-containing resin is concentrated and localized near the surface of uppermost layer during the formation of the layer due to difference in a surface free energy. As a result, the crosslinking reaction at the interface between the uppermost layer of electrophotographic light-sensitive element and the non-tacky resin layer effectively proceeds.

The polymer components containing a fluorine atom and/or silicon atom may present at random or in the form of block. A block copolymer containing a polymer segment having a fluorine atom and/or silicon atom as a block is preferred. The polymer component containing a fluorine atom and/or a silicon atom and the block copolymer which can be used are described in detail in EP-A-534,479.

Where the polymer containing a fluorine atom and/or silicon atom-containing polymer component used in the present invention is a random copolymer the content of the fluorine atom and/or silicon atom-containing polymer component is preferably at least 40% by weight, and more preferably at least 60% by weight based on the total polymer component.

In a preferred embodiment, the above-described polymer is a block copolymer comprising at least one polymer segment (β) containing at least 50% by weight of a fluorine atom and/or silicon atom-containing polymer component and at least one polymer segment (β) containing 0 to 20% by weight of a fluorine atom and/or silicon atom-containing polymer component, the polymer segments (α) and (β) being bonded in the form of blocks.

The reactive group-containing resin is preferably employed in such an amount that the content of the reactive group-containing polymer component present therein is from 1 to 30% by weight based on the total component of the uppermost layer of electrophotographic light-sensitive element.

According to the method of the present invention, a non-fixing toner image is formed on the electrophotographic light-sensitive element by a conventional electrophotographic process.

The non-fixing toner image means a toner image having adhesion to the electrophotographic light-sensitive element smaller than adhesion of the non-tacky resin layer to the electrophotographic light-sensitive element. The toner image may be subjected to a fixing treatment as long as the above described condition is maintained. The toner image preferably has a force necessary for releasing from the surface of electrophotographic light-sensitive element not more than 20 g·f as measured in the aforesaid method.

The formation of non-fixing toner layer can be easily performed using a conventionally known developer by eliminating a fixing process with heat.

Where conduction of a certain amount of heat occurs during the electrophotographic process or the succeeding formation step of non-tacky resin layer, the condition described above can be fulfilled by modifying a material for forming the toner image. Specifically, there are (1) a method of using a resin having a glass transition point of not less than 50° C., preferably not less than 80° C. for forming a resin grain of toner, (2) a method of using a cured resin grain having a crosslinked structure therein as described, for example, in JP-A-5-34998, JP-A-5-150562, and U.S. Pat. No. 5,334,475 as a resin grain of toner, and (3) a method of using a colored grain composed of a pigment and a binder resin wherein a content of the pigment is not less than 50% by weight, preferably not less than 80% by weight. A grain of pigment only may be employed.

In order to form the toner image by an electrophotographic process according to the present invention, any method conventionally known can be employed, as long as the above described condition is fulfilled.

Suitable methods are described in the literature references mentioned with respect to the electrophotographic light-sensitive element above.

The developers which can be used in the present invention include conventionally known developers for electrostatic photography, either dry type or liquid type. For example, specific examples of the developer are described in *Denshishashin Gijutsu no Kiso to Oyo, supra*, pp. 497–505, Koichi Nakamura (ed.), *Toner Zairyo no Kaihatsu-Jitsuyoka*, Ch. 3, Nippon Kagaku Joho (1985), Gen Machida, *Kirokuyo Zairyo to Kankosei Jushi*, pp. 107–127 (1983), and Denshishasin Gakkai (ed.), *Imaging*, Nos. 2–5, "Denshishashin no Genzo.Teichaku.Taiden.Tensha", Gakkai Shuppan Center.

Dry developers practically used include one-component magnetic toners, two-component toners,one-component non-magnetic toners, and capsule toners. Any of these dry developers may be employed in the present invention.

The typical liquid developer is basically composed of an electrically insulating organic solvent, for example, an isoparaffinic aliphatic hydrocarbon (e.g., isopar H or isopar G (manufactured by Esso Chemical Co.), Shellsol 70 or Shellsol 71 (manufactured by Shell Oil Co.) or IP-Solvent 1620 (manufactured by Idemitsu Petro-Chemical Co., Ltd.)) as a dispersion medium, having dispersed therein a colorant (e.g., an organic or inorganic pigment or dye) and a resin for imparting dispersion stability, fixability, and charge-ability to the developer (e.g., an alkyd resin, an acrylic resin, a polyester resin, a styrene-butadiene resin, and rosin). If desired, the liquid developer can contain various additives for enhancing charging characteristics or improving image characteristics.

The colorant is appropriately selected from known dyes and pigments, for example, benzidine type, azo type, azomethine type, xanthene type, anthraquinone type, phthalocyanine type (including metallized type), titanium white, nigrosine, aniline black, and carbon black.

Other additives include, for example, those described in Yuji Harasaki, *Denshishashin*, Vol. 16, No. 2, p. 44, such as di-2-ethylhexylsufosuccinic acid metal salts, naphthenic acid metal salts, higher fatty acid metal salts, alkylbenzenesulfonic acid metal salts, alkyphosphoric acid metal salts, lecithin, polyvinylpyrrolidone, copolymers containing a maleic acid monoamido component, coumarone-indene resins, higher alcohols, polyethers, polysiloxanes, and waxes.

With respect to the content of each of the main components of the liquid developer, toner particles comprising a resin (and, if desired, a colorant) are preferably present in an amount of from 0.5 to 50 parts by weight per 1000 parts by weight of a carrier liquid. if the toner content is less than 0.5 part by weight, the image density may be insufficient, and if it exceeds 50 parts by weight, the occurrence of fog in the non-image areas may be tended to.

If desired, the above-described resin for dispersion stabilization which is soluble in the carrier liquid is added in an amount of from about 0.5 to about 100 parts by weight per 1000 parts by weight of the carrier liquid. The above-described charge control agent can be preferably added in an amount of from 0.001 to 1.0 part by weight per 1000 parts by weight of the carrier liquid. Other additives may be added to the liquid developer, if desired. The upper limit of the total amount of other additives is determined, depending on electrical resistance of the liquid developer. Specifically, the total amount of additive is preferably controlled so that the liquid developer exclusive of toner particles has an electrical resistivity of not less than $10^9$ Ωcm. if the resistivity is less than $10^9$ Ωcm, a continuous gradation image of good quality may hardly be obtained.

The liquid developer can be prepared, for example, by mechanically dispersing a colorant and a resin in a dispersing machine, e.g., a sand mill, a ball mill, a jet mill, or an attritor, to produce colored particles, as described, for example, in JP-B-35-5511, JP-B-35-13424, JP-B-50-40017, JP-B-49-98634, JP-B-58-129438, and JP-A-61-180248 .

The colored particles may also be obtained by a method comprising preparing dispersed resin grains having a fine grain size and good monodispersity in accordance with a non-aqueous dispersion polymerization method and coloring the resulting resin grains. In such a case, the dispersed grains prepared can be colored by dyeing with an appropriate dye as described, for example, in JP-A-57-48738, or by chemical bonding of the dispersed grains with a dye as described, for example, in JP-A-53-54029. It is also effective to polymerize a monomer already containing a dye at the polymerization granulation to obtain a dye-containing copolymer as described, for example, in JP-B-44-22955.

The thickness of toner image is 0.5 μm or more, and preferably in a range of from 2 to 3 μm. In such a range of layer thickness, the non-tacky resin layer on the toner image portion is easily removed in the succeeding removing step of toner image portion. This is also advantageous to prevent from using an unnecessarily large amount of the toner.

In the method of the present invention, a combination of a scanning exposure system using a laser beam based on digital information and a development system using a liquid developer is an advantageous process in order to form highly accurate images.

It is preferred in the present invention that the toner image which is formed by the electrophotographic process on the electrophotographic light-sensitive element and covered with the non-tacky resin layer in the succeeding step is removed together with the non-tacky resin layer positioned thereof by a dry process using application of, for example, a mechanical power.

On the whole surface of electrophotographic light-sensitive element, the non-tacky resin layer is provide. The method for providing the non-tacky resin layer is not particularly limited and any conventionally known method can be employed. Specifically, when the non-tacky resin is a liquid form or soluble in a solvent, methods using doctor coater, a blade coater, a knife coater, a squeeze coater, a dip coater, a reverse roll coater, a transfer roll coater, a gravure coater, a kiss roll coater, a spray coater, a curtain coater, or a calender coater as described, for example, in Yuji Harasaki, *Coating Kogaku*, Asakura Shoten (1971), Yuji Harasaki,

*Coating Hoshiki*, Maki Shoten (1979), and Hiroshi Fukada, *Hot-melt Secchaku no Jissai* Kobunshi Kankokai (1979) can be used. An ink jet method as described in Shin Ohno (ed.), *Non-impact Printing*, C.M.C. (1986) including, a Sweet process or Hartz process of a continuous jet type, a Winston process of an intermittent jet type, a pulse jet process of an ink on-demand type, a bubble jet process, and a mist process of an ink mist type can also be employed.

Further, a method wherein the non-tacking resin layer provided on a releasable support typically represented by release paper (hereinafter simply referred to as release paper) is transferred onto the surface of electrophotographic light-sensitive element having the toner image is usable.

The release paper having the non-tacky resin layer thereon is simply supplied to a transfer device in the form of a roll or sheet.

The release paper which can be employed in the present invention include those conventionally known as described, for example, in *Nenchaku (Nensecchaku) no Shin Gijutsu to Sono Yoto. Kakushu Oyoseihin no Kaihatsu Siryo*, published by Keiei Kaihatsu Center Shuppan-bu (May 20, 1978), and *All Paper Guide Shi no Shohin Jiten, Jo Kan, Bunka Sangyo Hen*, published by Shigyo Times Sha (Dec. 1, 1983).

Specifically, the release paper comprises a substrate such as nature Clupak paper laminated with a polyethylene resin, high quality paper pre-coated with a solvent-resistant resin, kraft paper, a PET film having an under-coating or glassine having coated thereon a release agent mainly composed of silicone.

A solvent type of silicone is usually employed and a solution thereof having a concentration of from 3 to 7% by weight is coated on the substrate, for example, by a gravure roll, a reverse roll or a wire bar, dried and then subjected to heat treatment at not less than 150° C. to be cured. The coating amount is usually about 1 g/m$^2$.

Release paper for tapes, labels, formation industry use and cast coat industry use each manufactured by a paper making company and put on sale are also generally employed. Specific examples thereof include Separate Shi (manufactured by Oji Paper Co., Ltd.), King Rease (manufactured by Shikoku Seishi K.K.), San Release (manufactured by Sanyo Kokusaku Pulp K.K.) and NK High Release (manufactured by Nippon Kako Seishi K.K.).

In order to form the non-tacky resin layer on release paper, a composition for the non-tacky resin layer is applied to releasing paper in a conventional manner, for example, by bar coating, spin coating or spray coating.

For a purpose of transfer of the non-tacky resin layer on release paper to the electrophotographic light-sensitive element bearing the toner image, a conventional heat transfer method is utilized. Specifically, release paper having the non-tacky resin layer thereon is pressed on the electrophotographic light-sensitive element to heat transfer the non-tacky resin layer.

The conditions for transfer of the non-tacky resin layer from release paper to the surface of electrophotographic light-sensitive element are preferably as follows. A nip pressure of the roller is from 0.1 to 20 kgf/cm$^2$ and more preferably from 0.2 to 10 kgf/cm$^2$. A temperature at the transfer is from 25° to 200° C. and more preferably from 40° to 150° C.

The non-tacky resin layer is preferably cured as described above. Further, it is preferred that the non-tacky resin layer firmly adheres to the surface of electrophotographic light-sensitive element by a chemical bond.

The formation of such state of the non-tacky resin layer can be achieved by appropriate application of heat and/or radiation during or after the coating or transfer of the layer. The application of heat and/or radiation is preferably conducted under the condition described above.

After providing the non-tacky resin layer on the electrophotographic light-sensitive element bearing the toner image, the element is subjected to selective removal of the non-tacky resin layer only in the toner image portion. In order to selectively remove the non-tacky resin layer, a wet process, for example, a method as described in JP-A-49-121602 or a dry process can be employed. The dry process is preferred in view of simplification of the operation. The dry process is not particularly limited and any method including application of power from outside can be utilized in the present invention.

Specific examples of the suitable method include a peel apart method using an adhesive sheet, a brushing method using a brush and a rubbing method using a rubber.

Further, in case of providing the non-tacky resin layer by the transfer method from release paper, the toner image portion is removed at the time of peeling the release paper by appropriately controlling the releasability between the non-tacky resin layer and the release paper. Specifically, the non-tacky resin layer on release paper is pressed to the electrophotographic light-sensitive element and when the release paper is stripped, the non-tacky resin layer in the non-image portion is transferred and remains on the electrophotographic light-sensitive element and on the other hand, the non-tacky resin layer in the toner image portion is removed together with the release paper.

Separation of the electrophotographic light-sensitive element and the non-tacky resin layer in the toner image may take place at the interface between the toner image and the surface of the light-sensitive element or the non-tacky resin layer, or in the layer of the toner image (due to the so-called "cohesive failure"). The toner image may be removed together with the non-tacky resin layer upon the separation or may be left on the light-sensitive element.

In accordance with the present invention, the method for preparation of a waterless lithographic printing plate by an electrophotographic process which is suitable for a scanning exposure system using a laser beam of a low power and which provides a lithographic printing plate excellent in image qualities and printing durability in a simple, rapid and laborsaving manner is provided. The waterless lithographic printing plate obtained is capable of faithfully reproducing a highly accurate image.

The present invention is illustrated in greater detail with reference to the following examples, but the present invention is not to be construed as being limited thereto.

EXAMPLE 1

A mixture of 100 g of photoconductive zinc oxide, 6 g of Binder Resin (A-1) having the structure shown below, 30 g of Binder Resin (A-2) having the structure shown below, 0.018 g of Methine Dye (I) having the structure shown below, 0.20 g of phthalic anhydride and 300 g of toluene was dispersed by a homogenizer (manufactured by Nippon Seiki K.K.) at a rotation of $7\times10^3$ r.p.m. for 10 minutes to prepare a dispersion for a photoconductive layer.

Binder Resin (A-1)

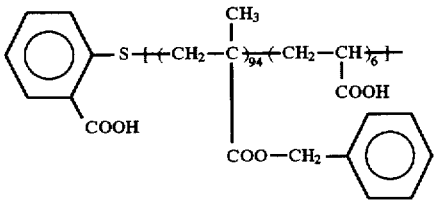

Mw $6.0 \times 10^3$

Binder Resin (A-2)

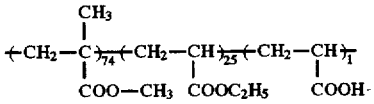

Mw $5.3 \times 10^4$

Methine Dye (I)

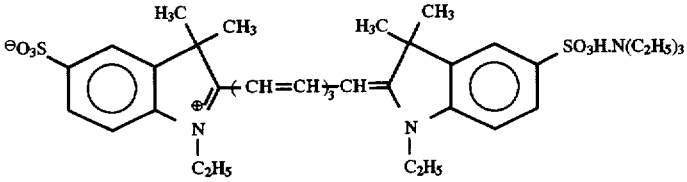

The resulting dispersion was coated on an aluminium support having a thickness of 0.2 mm, which had been subjected to degrease treatment, by a wire bar at a dry coverage of 25 g/m$^2$, heated at 110° C. for one minute, and allowed to stand in a dark place under conditions of 20° C. and 65% RH for 24 hours to prepare an electrophotographic light-sensitive element.

Using the resulting electrophotographic light-sensitive element, the formation of a toner image, provision of a non-tacky resin layer and removal of the non-tacky resin layer in the image portion were conducted to prepare a waterless lithographic printing plate in the following manner.

The electrophotographic light-sensitive element was charged to −450 V with a corona charger and image-exposed using a Ga-Al-As semiconductor laser having an output 5 mW and an oscillation wavelength of 780 nm based on an information which had been obtained by reading an original by a color scanner and memorized in a hard disc as digital image data at a beam spot diameter of 15 μm, a pitch of 10 μm and a scanning speed of 300 cm/sec. (i.e., 2500 dpi). The exposure energy on the surface of electrophotographic light-sensitive element was 30 erg/cm$^2$.

Then, the exposed electrophotographic light-sensitive element was subjected to development using Liquid Developer (LD-1) prepared in the manner as described below while applying a bias voltage of −30 V to an electrode on the surface side of electrophotographic light-sensitive element to electrodeposit toner particles on the non-exposed areas, whereby a toner image was formed. The electrophotographic light-sensitive element was rinsed with isopar G as a rinsing bath. The toner image was not fixed.

Preparation of Liquid Developer (LD-1)

1) Synthesis of Toner Particles:

A mixed solution of 100 g of methyl methacrylate, 20 g of a dispersion polymer having the structure shown below, and 680 g of isopar H was heated to 65° C. under nitrogen gas stream with stirring. To the solution was added 1.0 g of 2,2'-azobis(isovaleronitrile) (abbreviated as AIVN), followed by reacting for 4 hours. To the reaction mixture was further added 0.5 g of AIVN, and the reaction was continued for 2 hours. To the reaction mixture was further added 0.5 g of AIVN, and the reaction was continued for 2 hours. The temperature was raised up to 90° C., and the mixture was stirred under a reduced pressure of 30 mm Hg for 1 hour to remove any unreacted monomers. After cooling to room temperature, the reaction mixture was filtered through a nylon cloth of 200 mesh to obtain a white dispersion. The reaction ratio of the monomers was 95% by weight, and the resulting dispersion had an average grain diameter of resin grain of 0.25 μm (measured by CAPA-500 manufactured by Horiba, Ltd.) and good monodispersity. A Tg of the resin was 115° C.

Dispersion Polymer

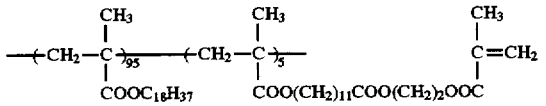

Mw $4 \times 10^4$ (weight ratio)

2) Preparation of Colored Particles:

Ten grams of a tetradecyl methacrylate/methacrylic acid copolymer (95/5 ratio by weight), 10 g of nigrosine, and 30 g of Isopar G were put in a paint shaker (manufactured by Toyo Seiki Seisakusho Co.) together with glass beads and dispersed for 4 hours to prepare a fine dispersion of nigrosine.

3) Preparation of Liquid Developer:

A mixture of 45 g of the above-prepared toner particle dispersion, 25 g of the above-prepared nigrosine dispersion, 0.6 g of a hexadecene/maleic acid monooctadecylamide (1/1 ratio by mole) copolymer, and 15 g of branched octadecyl alcohol (FOC-1800 manufactured by Nissan Chemical Industries, Ltd.) was diluted with 1 l of Isopar G to prepare Liquid Developer (LD-1) for electrophotography.

The toner image formed on the electrophotographic light-sensitive element faithfully reproduced a highly accurate image. Specifically, a range of from 1 to 99% in dots of 175 lines per inch, a fine line of 10 μm in width (i.e., resolving power of 50 lines/mm) and 2.2 point size of Ming-zhao character were clearly reproduced without cutting. Also, background stain in the non-image portion was not observed at all.

On the electrophotographic light-sensitive element bearing the toner image was provided a non-tacky resin layer composed of silicone rubber. Specifically, a mixed solution of 6 g of silicone rubber of condensation type (KS705F manufacture by Shin-Etsu Silicone Co., Ltd.), 240 mg of CAT-PS-1 (manufactured by Shin-Etsu Silicone Co., Ltd.), 120 mg of CAT-PD (manufactured by Shin-Etsu Silicone Co., Ltd.) and 34 g of heptane was coated on the whole electrophotographic light-sensitive element bearing the toner image by a wire bar and heated at 90° C. for 2 minutes to conduct drying and curing, thereby forming a non-tacky resin layer having a thickness of 2.12 μm.

Then, the non-tacky resin layer was uniformly rubbed with a PS sponge (manufactured by Fuji Photo Film Co., Ltd.) to remove the non-tacky resin layer only in the toner image portion. As a result, a pattern of the non-tacky resin layer of silicone rubber corresponding to the non-image portion was formed. In the image portion of the resulting lithographic printing plate obtained by removing the non-tacky resin layer using the dry proces, a range of from 3 to 99% in dots of 175 lines per inch, a fine line of 10 μm in width and 2.2 point size of Ming-zhao character were maintained.

The printing plate was subjected to printing using a printing machine (Toko Offset 810L manufactured by Tokyo Koku Keiki Co., Ltd. and a black ink (Dri-O-Color manufactured by Dainippon ink and Chemicals, inc. without supplying dampening water. More than 50,000 good prints wherein the image was clear without cutting of fine line and fine letter, a range of from 3 to 98% in dots of 175 lines per inch, a fine line of 10 μm in width and 2.2 point size of Ming-zhao character were reproduced, and background stain was not recognized at all in the non-image portion.

Comparative Example 1

The electrophotographic light-sensitive element same as used in Example 1 was charged to −450 V with a corona charger and image-exposed using a Ga-Al-As semiconductor laser having an output 5 mW and an oscillation wavelength of 780 nm based on an information which had been obtained by reading an original by a color scanner and memorized in a hard disc as digital image data at a beam spot diameter of 15 μm, a pitch of 10 μm and a scanning speed of 300 cm/sec. (i.e., 2500 dpi). The exposure energy on the surface of electrophotographic light-sensitive element was 30 erg/cm$^2$.

Then, the exposed electrophotographic light-sensitive element was subjected to reversal development using a liquid developer for cassette file (ECF 1000 manufactured by Fuji Photo Film Co., Ltd.) while applying a bias voltage of −170 V to an electrode on the surface side of electrophotographic element to electrodeposit toner particles on the exposed areas, whereby a toner image was formed. After rinsing with Isoper G, the toner image was heated at 140° C. for 5 minutes to conduct sufficient fixing.

On the electrophotographic light-sensitive element bearing the toner image was provided a non-tacky resin layer in the same manner as in Example 1. A thickness of the resulting non-tacky resin layer of silicone rubber was 2.15 μm.

Then, the non-tacky resin layer was rubbed to remove it in the toner image portion under the same condition as in Example 1 to prepare a lithographic printing plate. Using the resulting printing plate, printing was performed in the same manner as in Example 1. Only prints of poor image reproduction were obtained due to insufficient adhesion of ink to the image portion.

As a result of observation of the printing plate using a scanning electron microscope (JSM-T330 manufactured by JEOL Ltd.), it was found that the non-tacky resin layer was not sufficiently removed in the image areas.

The sufficient removal of non-tacky resin layer in the image potion was achieved by conducting rubbing with the sponge under a hard condition. Under such condition, however, many scratches occurred in the non-image portion of non-tacky resin layer which resulted in stains on prints. Consequently, it is difficult to sufficiently remove the non-tacky resin layer in the image portion without damaging the non-image portion of non-tacky resin layer.

It is believed that a reason for the poor removal of non-tacky resin layer in the image portion as described in Comparative Example 1 resides in a small difference between adhesion of the surface of electrophotographic light-sensitive element to the non-tacky resin layer in the non-image portion (350 g·f) and adhesion of the surface of fixed toner image to the non-tacky resin layer in the image portion (400 g·f or more). The measurement of adhesion was conducted by the method described above.

On the contrary, in the method of Example 1, the toner image was not fixed (adhesion of 3 g·f) and the non-tacky resin layer in the image portion did not substantially adhere to the toner image. Therefore, the non-tacky resin layer in the image portion was easily removed without suffering any damage on the non-tacky resin layer in the non-image portion.

EXAMPLE 2

An electrophotographic light-sensitive element prepared, charged and exposed imagewise in the same manner as in Example 1 was subjected to development using a liquid developer (ELP-TX manufactured by Fuji Photo Film Co., Ltd.) while applying a bias voltage of −35 V to an electrode on the surface side of electrophotographic light-sensitive element to electrodeposit toner particles on the non-exposed areas, whereby a toner image was formed. The toner employed had a relatively low softening point of 45° C.

Without fixing the toner image, the electrophotographic light-sensitive element was subjected to the formation of non-tacky resin layer and removal of non-tacky resin layer in the image portion to prepare a lithographic printing plate and printing using the resulting plate in the same manner as in Example 1. More than 30,000 good prints of clear image without stain in the non-image portion were obtained. Adhesion of the non-tacky resin layer to the surface of electrophotographic light-sensitive element in the non-image portion was 300 g·f, while adhesion of the toner image to the surface of electrophotographic light-sensitive element was 5 g·f.

Although the toner having relatively low softening point was employed in the method of Example 2, the sufficient difference in adhesion was maintained in comparison with the method of Comparative Example 1 including the heat-fixing step of toner.

EXAMPLE 3

On an electrophotographic light-sensitive element prepared and having a toner image formed thereon in the same manner as in Example 1 was coated silicone rubber of ultraviolet ray-curable type (TFC7700 manufactured by Toshiba Silicone Co., Ltd.) by a wire bar to form a non-tacky resin layer and the layer was irradiated with a high pressure mercury lump (UM 102 manufactured by Ushio Inc.) at a distance of 5 cm for 30 seconds. A thickness of the resulting non-tacky resin layer was 2.2 μm. Adhesion of the non-tacky resin layer to the surface of electrophotographic light-sensitive element in the non-image portion was 300 g·f or more and adhesion of the toner image to the surface of electrophotographic light-sensitive element was 5 g·f or less.

The non-tacky resin layer was uniformly brushed to remove the non-tacky resin layer only in the image portion, whereby a pattern of the non-tacky resin layer of silicone rubber corresponding to the non-image portion was formed.

The resulting lithographic printing plate was subjected to printing in the same manner as in Example 1. More than 50,000 good prints of clear image without stain in the non-image portion were obtained.

EXAMPLE 4

A mixture of 1.5 g of X-form metal-free phthalocyanine, 13.5 g of Binder Resin (A-3) having the structure shown below, and 85 g of toluene was put into a 200 ml-volume plastic container together with 180 g of glass beads and dispersed in a paint shaker (manufactured by Toyo Seiki Seisakusho Co.) for 60 minutes. The glass beads were separated by filtration to prepare a dispersion for a photoconductive layer.

Binder Resin (A-3)

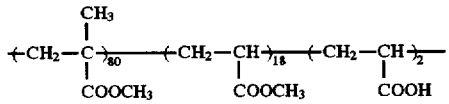

Mw $6.2 \times 10^4$

The resulting dispersion was coated on a support for an electrophotographic lithographic printing plate precursor (ELP-IIX manufactured by Fuji Photo Film Co., Ltd.) by a wire bar, set to touch and heated in an oven at 110° C. for one minute to form a photoconductive layer having a thickness of 6 μm.

The resulting electrophotographic light-sensitive element was charged to +460 V with a corona charger and image-exposed using a Ga-Al-As semiconductor laser having an output 5 mW and an oscillation wavelength of 780 nm based on an information which had been obtained by reading an original by a color scanner and memorized in a hard disc as digital image data at a beam spot diameter of 15 μm, a pitch of 10 μm and a scanning speed of 300 cm/sec. The exposure energy on the surface of electrophotographic light-sensitive element was 30 erg/cm$^2$.

The exposed electrophotographic light-sensitive element was subjected to development using a liquid developer for cassette file (ECF 1000 manufactured by Fuji Photo Film Co., Ltd.) while applying a bias voltage of −50 V to an electrode on the surface side of electrophotographic element to electrodeposit toner particles on the non-exposed areas, whereby a toner image was formed.

Without fixing the toner image, a mixed solution of 6 g silicone rubber of addition type (KS774 manufactured by Shin-Etsu Silicone Co., Ltd.), 180 mg of CAT-PL-4 (manufactured by Shin-Etsu Silicone Co., Ltd.) and 34 g of heptane was coated on the whole electrophotographic light-sensitive element bearing the toner image by a wire bar and heated at 90° C. for 2 minutes to conduct drying and curing, thereby forming a non-tacky resin layer having a thickness of 2.05 μm. Adhesion of the non-tacky resin layer to the surface of electrophotographic light-sensitive element in the non-image portion was 300 g·f or more and adhesion of the toner image to the surface of electrophotographic light-sensitive element was 5 g·f or less.

The removal of non-tacky resin layer in the image portion to prepare a lithographic printing plate and printing using the resulting plate were conducted in the same manner as in Example 1. More than 10,000 good prints of clear image without stain in the non-image portion were obtained.

EXAMPLE 5

An electrophotographic light-sensitive element prepared, charged and imagewise exposed in the same manner as in Example 4 was subjected to reversal development using Liquid Developer (LD-2) prepared in the manner as described below while applying a bias voltage of +150 V to an electrode on the surface side of electrophotographic light-sensitive element to electrodeposit toner particles on the exposed areas, whereby a toner image was formed.

Preparation of Liquid Developer (LD-2)

1) Synthesis of Toner Particles:

A mixed solution of 100 g of vinyl acetate, 8 g of a dispersion polymer having the structure shown below and 680 g of Isopar H was heated to 65° C. under nitrogen gas stream with stirring. To the solution was added 1.0 g of 2,2'-azobis(isovaleronitrile) (abbreviated as AIVN), followed by reacting for 4 hours. To the reaction mixture was further added 0.5 g of AIVN, and the reaction was continued for 2 hours. The temperature was raised up to 90° C., and the mixture was stirred under a reduced pressure of 30 mm Hg for 1 hour to remove any unreacted monomers. After cooling to room temperature, the reaction mixture was filtered through a nylon cloth of 200 mesh to obtain a white dispersion. The reaction ratio of the monomers was 94% by weight, and the resulting dispersion had an average grain diameter of resin grain of 0.23 μm (measured by CAPA-500 manufactured by Horiba, Ltd.) and good monodispersity. A Tg of the resin was 35° C.

Dispersion Polymer

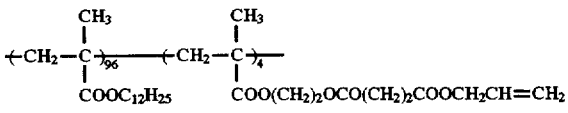

Mw $5 \times 10^4$

2) Preparation of Colored Particles:

Ten grams of an octadecyl methacrylate/methacrylic acid copolymer (98/2 ratio by weight), 15 g of alkali blue, and 30 g of Isopar G were put in a paint shaker (manufactured by Toyo Seiki Seisakusho Co.) together with glass beads and dispersed for 4 hours to prepare a fine dispersion of alkali blue.

3) Preparation of Liquid Developer:

A mixture of 15 g of the above-prepared toner particle dispersion, 70 g of the above-prepared alkali blue dispersion, 0.6 g of a hexadecene/maleic acid monooctadecytamide (1/1 ratio by mole) copolymer, and 15 g of branched octadecyl alcohol (FOC-1800 manufactured by Nissan Chemical Industries, Ltd.) was diluted with 1 l of Isopar G to prepare Liquid Developer (LD-2) for electrophotography.

A mixed solution of 6 g of silicone rubber of ultraviolet ray-curable type (UV9300 manufactured by Toshiba Silicone Co., LTD.), 60 mg of UV9310C (manufactured by Toshiba Silicone Co., LTD.) and 34 g of heptane was coated on the whole electrophotographic light-sensitive element bearing the toner image by a coating machine having a head unit and control unit of a small type ink-jet printer (manufactured by EPSON Co., Ltd.) equipped with an appropriate convey system and ink-feeding feeding system and irradiated with a high-pressure mercury lamp (UM-102 manufactured by Ushio Inc.) at a distance of 3 cm for 7 seconds. A thickness of the resulting non-tacky resin layer was 2.5 μm. Adhesion of the non-tacky resin layer to the surface of electrophotographic light-sensitive element in the non-image portion was 300 g·f or more and adhesion of the toner image to the surface of electrophotographic light-sensitive element was 5 g·f or less.

The removal of non-tacky resin layer in the image portion to prepare a lithographic printing plate and printing using the resulting plate were conducted in the same manner as in Example 1. More than 10,000 good prints of clear image without stain in the non-image portion were obtained.

EXAMPLE 6

On an electrophotographic light-sensitive element prepared and having a toner image formed thereon in the same manner as in Example 1 except for using a support for an electrophotographic lithographic printing plate precursor (ELP-IIX manufactured by Fuji Photo Film Co., Ltd.) in place of the aluminum support, was provided a non-tacky resin layer having improved adhesion to the surface of electrophotographic light-sensitive element in the non-image portion in the following manner.

A mixed solution of 9 g of Silicone Rubber Base Polymer (SB-1) having the structure shown below, 400 mg of Crosslinking Agent (SV-1) having the structure shown below, 40 mg of a catalyst X92-1114 manufactured by Shin-Etsu Silicone Co., Ltd.) and 60 g of heptane was coated on the whole electrophotographic light-sensitive element bearing the toner image by a wire bar and heated at 90° C. for 2 minutes to conduct drying and curing, thereby forming a non-tacky resin layer having a thickness of 2.21 μm. Adhesion of the non-tacky resin layer to the surface of electrophotographic light-sensitive element in the non-image portion was 300 g·f or more and adhesion of the toner image to the surface of electrophotographic light-sensitive element was 5 g·f or less.

Silicon Rubber Base Polymer (SB-1)

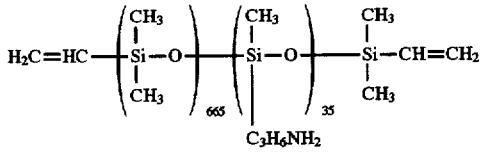

-continued

Silicon Rubber Base Polymer (SB-1)

Crosslinking Agent (SV-1)

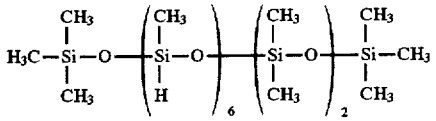

The removal of non-tacky resin layer in the image portion to prepare a lithographic printing plate and printing using the resulting plate were conducted in the same manner as in Example 1. More than 10,000 good prints of clear image without stain in the non-image portion were obtained.

EXAMPLE 7

The same procedure as in Example 6 was repeated except for using Silicone Rubber Base Polymer (SB-2) having the structure shown below in place of Silicone Rubber Base Polymer (SB-1). Adhesion of the non-tacky resin layer to the surface of electrophotographic light-sensitive element in the non-image portion was 300 g·f or more and adhesion of the toner image to the surface of electrophotographic light-sensitive element was 5 g·f or less. More than 10,000 good prints similar to those in Example 6 were obtained.

Silicone Rubber Base Polymer (SB-2)

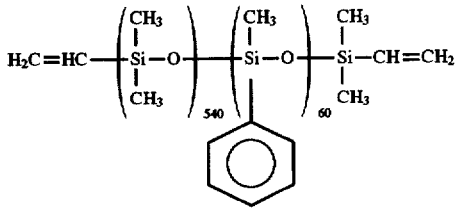

EXAMPLE 8

The same procedure as in Example 6 was repeated except for using Silicone Rubber Base Polymer (SB-3) having the structure shown below in place of Silicone Rubber Base Polymer (SB-1). Adhesion of the non-tacky resin layer to the surface of electrophotographic light-sensitive element in the non-image portion was 300 g·f or more and adhesion of the toner image to the surface of electrophotographic light-sensitive element was 5 g·f or less. More than 10,000 good prints similar to those in Example 6 were obtained.

Silicone Rubber Base Polymer (SB-3)

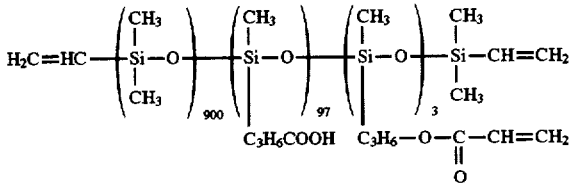

EXAMPLE 9

A mixture of 1.5 g of X-form metal-free phthalocyanine, 13.5 g of Binder Resin (A-4) having the structure shown below, 0.2 g of Compound (A) having the structure shown below, and 85 g of toluene was put into a 200 ml-volume plastic container together with 180 g of glass beads and dispersed in a paint shaker (manufactured by Toyo Seiki Seisakusho Co.) for 60 minutes. The glass beads were separated by filtration to prepare a dispersion for a photoconductivew layer.

Binder Resin (A-4)

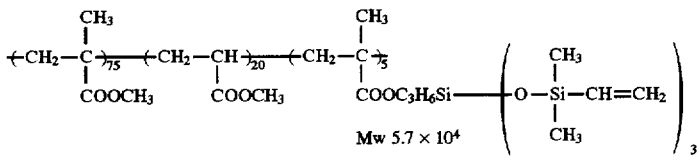

Compound (A)

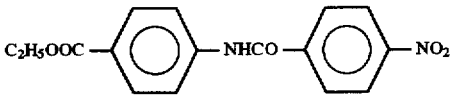

The resulting dispersion was coated on an aluminium plate having a thickness of 0.2 mm, which had been subjected to degrease treatment, by a wire bar, set to touch, and heated in an oven at 110° C. for one minute to form a photoconductive layer having a thickness of 6 μm.

The resulting electrophotographic light-sensitive element was charged to +460 V with corona charger and imagewise exposed under the same condition as in Example 1.

Then, the exposed electrophotographic light-sensitive element was subjected to reversal development using Liquid Developer (LD-1) while applying a bias voltage of +150 V to an electrode on the surface side of electrophotographic light-sensitive element to electrodeposit toner particles on the exposed areas, whereby a toner image was formed. The electrophotographic light-sensitive element was rinsed with Isopar G.

Without fixing the toner image, a mixed solution of 6 g silicone rubber of addition type (KS774 manufactured by Shin-Etsu Silicone Co., Ltd.), 180 mg of CAT-PL-4 (manufactured by Shin-Etsu Silicone Co., Ltd.) and 34 g of heptane was coated on the whole electrophotographic light-sensitive element bearing the toner image by a wire bar and heated at 90° C. for 2 minutes to conduct drying and curing thereby forming a non-tacky resin layer having a thickness of 2.05 μm. Adhesion of the non-tacky resin layer to the surface of electrophotographic light-sensitive element in the non-image portion was 300 g·f or more and adhesion of the toner image to the surface of electrophotographic light-sensitive element was 5 g·f or less.

The non-tacky resin layer was removed only in the image portion by brushing to prepare a lithographic printing plate. As a result of visual observation of the toner image portion on printing plate using an optical microscope of 200 magnifications, it was found that a highly accurate image such as a fine line of 10 μm in width and a range of from 2 to 98% in dots of 175 lines per inch was clearly formed without cutting.

Using the printing plate, printing was conducted in the same manner as in Example 1. More than 50,000 good prints wherein the highly accurate image was reproduced without substantial degradation and background stain was not recognized at all in the non-image portion were obtained.

It is believed that the formation of chemical bond at the interface between the non-tacky resin layer composed of silicone rubber of addition reaction type and the non-image portion of the electrophotographic light-sensitive element having the uppermost photoconductive layer containing Binder Resin (A-4) by a chemical reaction remarkably improves adhesion therebetween. As a result, even the fine image portion is easily removed due to the sufficient difference in adhesion in the image portion and in the non-image portion, and the highly accurate image is well reproduced on the print. Further, printing durability of the printing plate is improved.

EXAMPLE 10

A mixture of 100 g of photoconductive zinc oxide, 30 g of Binder Resin (A-5) having the structure shown below, 0.018 g of Methine Dye (II) having the structure shown below, 0.15 g of salicylic acid and 300 g of toluene was dispersed by a homogenizer (manufactured by Nippon Seiki K.K.) at a rotation of $7\times10^3$ r.p.m. for 10 minutes to prepare a dispersion for a photoconductive layer.

Binder Resin (A-5)

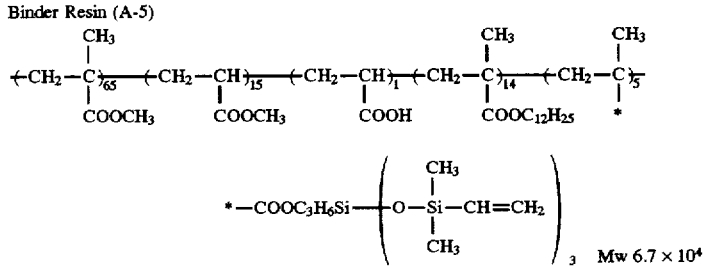

-continued

Methine Dye (II)

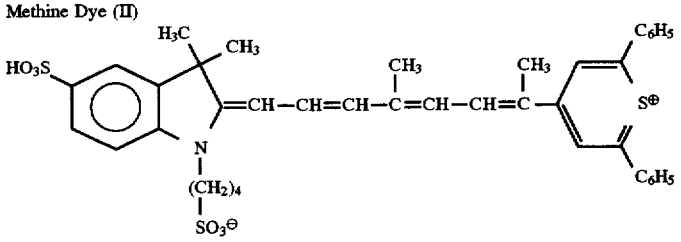

The resulting dispersion was coated on a support for an electrophotographic lithographic printing plate precursor (ELP-IIX manufactured by Fuji Photo Film Co., Ltd.) by a wire bar at a dry coverage of 25 g/m$^2$, heated at 110° C. for one minute, and allowed to stand in a dark place under conditions of 20° C. and 65% RH for 24 hours to prepare an electrophotographic light-sensitive element.

The electrophotographic light-sensitive element having an electrostatic latent image formed in the same manner as in Example 1 was subjected to development using a liquid developer (ELP-TX manufactured by Fuji Photo Film Co., Ltd.) while applying a bias voltage of −30 V to an electrode on the surface side of electrophotographic light-sensitive element to electrodeposit toner particles on the non-exposed areas, whereby a toner image was formed. The toner image was not fixed.

On the electrophotographic light-sensitive element bearing the toner image was uniformly provided a non-tacky resin layer in the following manner.

Preparation of Donor Sheet (DS-1)

On a PET film having a thickness of 100 μm treated a surface thereof with polyvinyl acetate (manufactured by Fuji Photo Film Co., Ltd.) was coated a mixed solution of 6 g of silicone rubber of addition type for release paper (X56-A5730 manufactured by Toshiba Silicone Co., Ltd.) and 36 g of heptane by a wire bar and dried at 90° C. for 2 minutes to prepare a non-tacky resin layer having a thickness of 2.2 μm.

On the electrophotographic light-sensitive element bearing the toner image was coated a crosslinking agent (CM620 manufactured by Toshiba Silicone Co., Ltd.) at a coverage of 30 μg/cm$^2$ by a wire bar. Then Donor Sheet (DS-1) was superposed thereon so that the non-tacky resin layer was brought into contact with the layer of crosslinking agent on the electrophotographic light-sensitive element, and the laminate was passed between a pair of rollers adjusted at 90° C. at a nip pressure of 5 Kg/cm$^2$ and a transportation speed of 40 cm/min. The PET film was peeled off and the silicon rubber was cured to provide the non-tacky resin layer on the electrophotographic light-sensitive element. Adhesion of the non-tacky resin layer to the surface of electrophotographic light-sensitive element in the non-image portion was 300 g·f or more and adhesion of the toner image to the surface of electrophotographic light-sensitive element was 5 g·f or less.

The removal of non-tacky resin layer in the image portion to prepare a lithographic printing plate and printing using the resulting plate were conducted in the same manner as in Example 1. More than 10,000 good prints of highly accurate image without stain in the non-image portion were obtained.

EXAMPLE 11

An electrophotographic light-sensitive element was prepared in the same manner in Example 10 except for using 4.5 g of Binder Resin (A-6) having the structure shown below, 25.5 g of Binder Resin (A-7) having the structure shown below and 0.020 g of Methine Dye (III) having the structure shown below in place of 30 g of Binder Resin (A-5) and 0.018 g of Methine Dye (II) respectively.

Binder Resin (A-6)

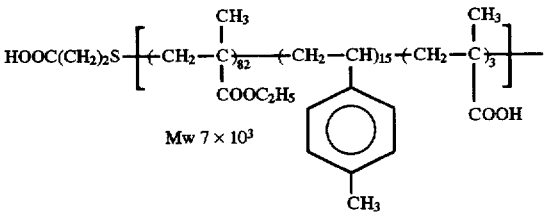

Mw 7 × 10$^3$

Binder Resing (A-7)

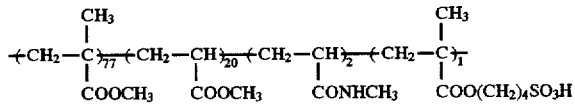

Mw 7.5 × 10$^4$

-continued

Methine Dye (III)

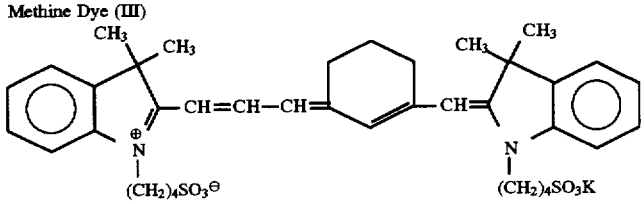

Preparation of Donor Sheet (DS-2)

On a PET film having a thickness of 100 μm (manufactured by Fuji Phoho Film Co., Ltd.) was coated a mixed solution of 6 g of silicone rubber of addition type for release paper (X56-A9293 manufactured by Toshiba Silicone Co., Ltd.), 0.1 g of a cross-linking agent (CM620 manufactured by Toshiba Silicone Co., Ltd.) and 40 g of heptane by a wire bar and dried to touch to prepare a non-tacky resin layer having a thickness of 2.2 μm.

Using the electrophotographic light-sensitive element and Donor Sheet (DS-2), a laminate thereof was formed according to the same procedure as in Example 10. Adhesion of the non-tacky resin layer to the surface of electrophotographic light-sensitive element in the non-image portion was 300 g·f or more and adhesion of the toner image to the surface of electrophotographic light-sensitive element was 5 g·f or less.

The PET film was then peeled off at an angle of 150 degree and a speed of 10 cm/sec. The non-tacky resin layer of cured silicone rubber in the image portion was removed together with the PET film while remaining on the electrophotographic light-sensitive element in the non-image portion, whereby a lithographic printing plate was prepared.

Printing was conducted using the printing plate in the same manner in Example 1 and more than 10,000 good prints of clear image without stain in the non-image portion were obtained. Fine lines and letters on the prints were clear-cut in comparison with those in Example 10. It was found as a result of the observation using an electron microscope that the diagonal cut of the non-tacky resin layer at the edge of non-image portion due to the rubbing for removing the non-tacky resin layer in the image portion did not occur in the peel-apart method as described above.

EXAMPLE 12

An electrophotographic light-sensitive element was prepared in the same manner in Example 10 except for using 3 g of Binder Resin (A-8) having the structure shown below and 22 g of Binder Resin (A-9) having the structure shown below in place of 30 g of Binder Resin (A-5).

Binder Resin (A-8)

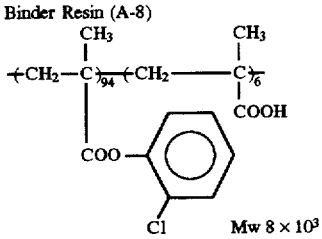

Mw 8 × 10³

Binder Resin (A-9)

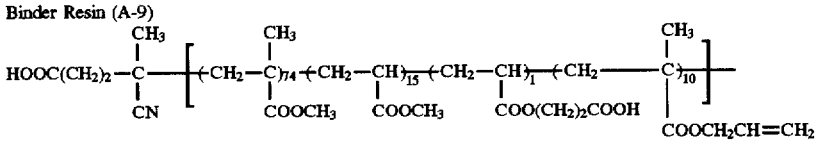

Mw 7 × 10⁴

The electrophotographic light-sensitive element was charged and imagewise exposed in the same manner as in Example 1, and then developed in a developing part of an electrophotographic copying machine (EP350Z manufactured by Minolta Co., Ltd.) using a dry developer to form a toner image. The toner image was not fixed.

The formation of non-tacky resin layer on the electrophotographic light-sensitive element bearing the toner image utilizing an ink-jet method, removal of non-tacky resin layer in the image portion to prepare a lithographic printing plate and printing using the resulting printing plate were conducted in the same manner as in Example 5. More than 10,000 good prints of clear image without stain in the non-image portion were obtained. Adhesion of the non-tacky resin layer to the surface of electrophotographic light-sensitive element in the non-image portion was 300 g·for more and adhesion of the toner image to the surface of electrophotographic light-sensitive element was 5 g·f or less.

EXAMPLE 13

Using the electrophotographic light-sensitive element bearing the toner image formed by a dry developer same as in Example 12, the formation of non-tacky resin layer, removal of non-tacky resin layer in the image portion to prepare a lithographic printing plate and printing were conducted in the same manner as in Example 11 except for employing silicone rubber of addition type for release paper (X56-A9293 manufactured by Toshiba Silicone Co., Ltd.) and a crosslinking agent (CM 621 manufactured by Toshiba Silicone Co., Ltd.). More than 10,000 good prints of clear image without stain in the non-image portion were obtained. Adhesion of the non-tacky resin layer to the surface of electrophotographic light-sensitive element in the non-image portion was 300 g·f or more and adhesion of the toner image to the surface of electrophotographic light-sensitive element was 5 g·f or less.

EXAMPLE 14

The preparation of electrophotographic light-sensitive element and formation of electrostatic latent image were conducted in the same manner as in Example 9 except for using Binder Resin (A-10) having the structure shown below.

Binder Resin (A-10)

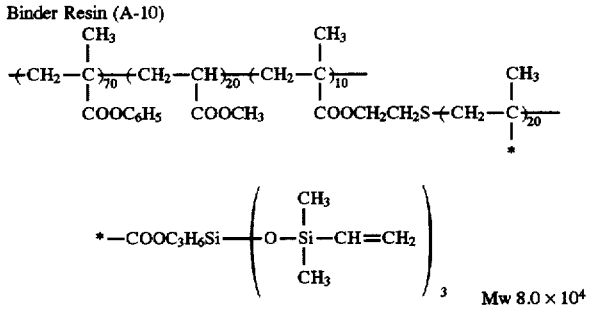

Mw 8.0 × 10⁴

The imagewise exposed electrophotographic light-sensitive element was then subjected to reversal development using a liquid developer (ELP-TX manufactured by Fuji Photo Film Co., Ltd.) while applying a bias voltage of +150 V to an electrode on the surface side of electrophotographic light-sensitive element to electrodeposit toner particles on the exposed areas, whereby a toner image was formed. The toner image was not fixed.

The formation of non-tacky resin layer on the electrophotographic light-sensitive element bearing the toner image, removal of non-tacky resin layer in the image portion to prepare a lithographic printing plate and printing the resulting printing plate were conducted in the same manner as in Example 6. More than 10,000 good prints of highly accurate image without stain in the non-image portion were obtained. Adhesion of the non-tacky resin layer to the surface of electrophotographic light-sensitive element in the non-image portion was 300 g·f or more and adhesion of the toner image to the surface of electrophotographic light-sensitive element was 5 g·f or less.

EXAMPLE 15

On an electrophotographic light-sensitive element prepared in the same manner as in Example 10 was coated a mixed solution of 30 g of silicone adhesive of tack-free type at a normal temperature (TSR 1520[A] manufactured by Toshiba Silicone Co., Ltd., 300 mg of a crosslinking agent (TSR 1520[B] manufactured by Toshiba Silicone Co., Ltd.) and 90 g of heptane by a wire bar, heated in an oven at 125° C. for 2 minutes to cure, whereby a silicone rubber layer having a thickness of 5 μm was formed.

The electrophotographic light-sensitive element was charged to −600 V with a corona charger and subjected to scanning exposure under the same condition as in Example 1 to form a latent image. The imagewise exposed electrophotographic light-sensitive element was then subjected to development using Liquid Developer (LD-1) while applying a bias voltage of −45 V to an electrode on the surface side of electrophotographic light-sensitive element to electrodeposit toner particles on the exposed areas, whereby a toner image was formed. The toner image was not fixed.

Preparation of Donor Sheet (DS-3)

On a PET film having a thickness of 100 μm treated a surface thereof with polyvinyl acetate (manufactured by Fuji Photo Film Co., Ltd.) was coated a mixed solution of 6 g of silicone rubber of addition type (KS774 manufactured by Shin-Etsu Silicone Co., Ltd.), 180 mg of CAT-PL-4 (manufactured by Shin-Etsu Silicone Co., Ltd.) and 34 g of heptane by a wire bar and heated at 90° C. for 2 minutes to conduct drying and curing, thereby forming a non-tacky resin layer having a thickness of 2.1 μm.

Donor Sheet (DS-3) was superposed on the electrophotographic light-sensitive element bearing the toner image described above so that the non-tacky resin layer of Donor Sheet (DS-3) was brought into contact with the surface of electrophotographic light-sensitive element, and the laminate was passed between a pair of rollers adjusted at 110° C. at a nip pressure of 5 Kg/cm² and a transportation speed of 20 cm/min. The PET film was then peeled off to provide the non-tacky resin layer on the electrophotographic light-sensitive element due to adhesion of the silicone adhesive. The non-tacky resin layer in the image portion did not substantially adhere to the surface of electrophotographic light-sensitive element since the silicone adhesive thereon was masked by the toner image. Adhesion of the non-tacky resin layer to the surface of electrophotographic light-sensitive element in the non-image portion was 300 g·f or more and adhesion of the toner image to the surface of electrophotographic light-sensitive element was 5 g·f or less.

The removal of non-tacky resin layer in the image portion to prepare a lithographic printing plate and printing using the resulting plate were conducted in the same manner as in Example 1. More than 10,000 good prints of clear image without stain in the non-image portion were obtained.

EXAMPLE 16

5 g of 4,4'-bis(diethylamino)-2,2'-dimethyltriphenylmethane as an organic photoconductive substance, 5 g of Binder Resin (A-11) having the structure shown below, 40 mg of Methine Dye (IV) having the structure shown below, and 0.2 g of Compound (A) described above as a chemical sensitizer were dissolved in a mixed solvent of 30 ml of methylene chloride and 30 ml of ethylene chloride to prepare a solution for a photoconductive layer.

Binder Resin (A-11)

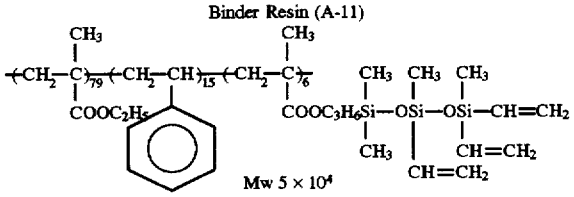

Mw 5 × 10⁴

Methine Dye (IV)

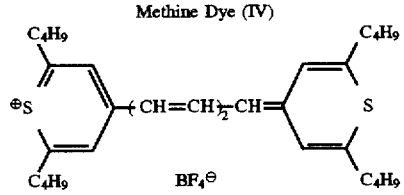

The resulting solution for photoconductive layer was coated on a conductive transparent substrate composed of a 100 μm thick polyethylene terephthalate film having a deposited layer of indium oxide thereon (surface resistivity: $10^3$ Ω) by a wire round rod to prepare an electrophotographic light-sensitive element having an organic photoconductive layer having a thickness of about 4 μm.

The procedure same as in Example 9 was repeated except for using the resulting electrophotographic light-sensitive element in place of the electrophotographic light-sensitive element employed in Example 9 to prepare a lithographic printing plate. Using the printing plate, printing was conducted in the same manner as in Example 9. More than 30,000 good prints of highly accurate image without background stain were obtained. Adhesion of the non-tacky resin layer to the surface of electrophotographic light-sensitive element in the non-image portion was 300 g·f or more and adhesion of the toner image to the surface of electrophotographic light-sensitive element was 5 g·f or less.

EXAMPLE 17

A mixture of 5 g of a bisazo pigment having the structure shown below, 95 g of tetrahydrofuran and 5 g of a polyester resin (Vylon 200 manufactured by Toyobo Co., Ltd.) was thoroughly pulverized in a ball mill. The mixture was added to 520 g of tetrahydrofuran with stirring. The resulting dispersion was coated on a conductive transparent substrate same as described in Example 16 by a wire round rod to prepare a charge generating layer having a thickness of about 0.7 μm.

Bisazo Pigment

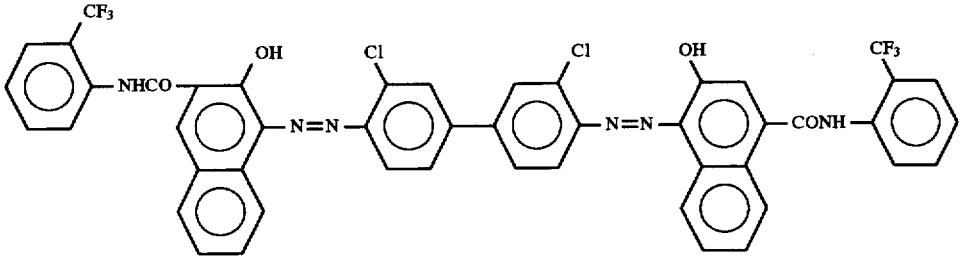

A mixed solution of 20 g of a hydrazone compound having the structure shown below, 10 g of a polycarbonate resin (Lexan 121 manufactured by General Electric Co., Ltd.), 10 g of Binder Resin (A-12) having the structure shown below and 160 g of tetrahydrofuran was coated on the above-described charge generating layer by a wire round rod, dried at 60° C. for 30 seconds and then heated at 100° C. for 20 seconds to form a charge transporting layer having a thickness of about 18 μm, whereby an electrophotographic light-sensitive element having a double-layered structure was prepared.

Hydrazone Compound

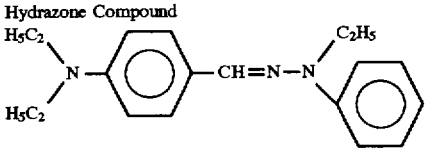

Binder Resin (A-12)

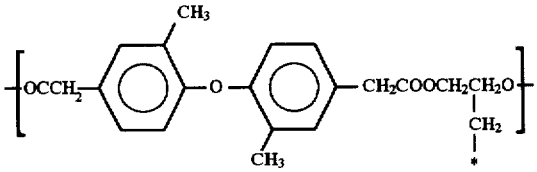

-continued

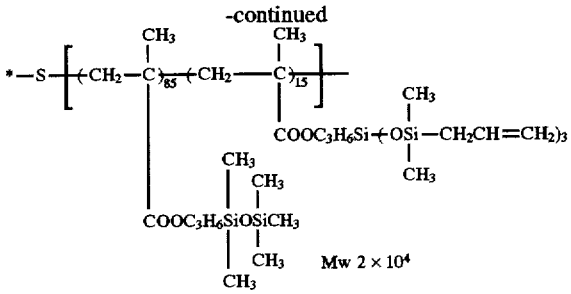

Mw $2\times10^4$

The resulting electrophotographic light-sensitive element was charged to a surface potential of −500 V in a dark place and exposed imagewise using a helium-neon laser of 633 nm at a beam spot diameter of 15 μm, a pitch of 10 μm and an irradiation dose on the surface of the light-sensitive element of 30 erg/cm$^2$, followed by conducting the same procedure as in Example 1 to prepare a lithographic printing plate. As a result of offset printing using the resulting printing plate in the same manner as in Example 1, more than 30,000 good prints of highly accurate image without background stain similar to Example 1 were obtained. Adhesion of the non-tacky resin layer to the surface of electrophotographic light-sensitive element in the non-image portion was 300 g·for more and adhesion of the toner image to the surface of electrophotographic light-sensitive element was 5 g·f or less.

EXAMPLE 18

A lithographic printing plate was prepared in the same manner as in Example 9 except for using Liquid Developer (LD-3) described below in place of Liquid Developer (LD-1) employed in Example 9. Adhesion of the non-tacky resin layer to the surface of electrophotographic light-sensitive element in the non-image portion was 300 g·f or more and adhesion of the toner image to the surface of electrophotographic light-sensitive element was 5 g·f or less.

Preparation of Liquid Developer (LD-3)

A mixed solution of 60 g of methyl methacrylate, 40 g of methyl acrylate, 5 g of acrylic acid, 15 g of ethyleneglycol dimethacrylate, 2.6 g of 3-mercaptopropionic acid, 15 g of a dispersion polymer having the structure shown below and 550 g of Isopar G was heated to 60° C. under nitrogen gas stream with stirring.

Dispersion Polymer

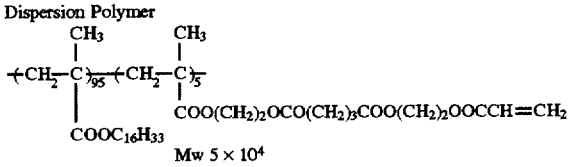

Mw $5 \times 10^4$

To the solution was added 1.5 g of 2,2'-azobis (isobutyronitrile) (abbreviated as AIBN), followed by reacting for 3 hours. To the reaction mixture was further added 0.8 g of AIBN, and the reaction was continued for 2 hours. To the reaction mixture was further added 0.8 g of AIBN, and the reaction was continued for 3 hours at a temperature of 80° C. The temperature was raised up to 90° C., and the mixture was stirred under a reduced pressure of 30 mm Hg for 1 hour to remove any unreacted monomers. After cooling to a room temperature, the reaction mixture was filtered through a nylon cloth of 200 mesh to obtain a white dispersion. The reaction ratio of the monomers was 98% by weight, and the resulting dispersion had an average grain diameter of resin grain of 0.22 μm (measured by CAPA-500 manufactured by Horiba, Ltd.) and good monodispersity. The resin grain was not form a uniform layer even when heated at a temperature of 120° C. for 30 minutes since it had a crosslinked structure.

A mixture of 100 g of the above described dispersion and 3 g of a basic dye (Victoria Blue B) was heated at a temperature range of from 70° C. to 80° C. and stirred for 6 hours. After cooling to a room temperature, the mixture was filtered through a nylon cloth of 200 mesh and the remaining dye was removed to obtain a blue dispersion of resin grain having an average grain diameter of 0.22 μm.

A mixture of 32 g of the resulting blue dispersion and 0.05 g of octadecyl vinyl ether/maleic acid monotridecylamide (1/1 ratio by mole) copolymer was diluted with one liter of Isopar G to prepare Liquid Developer (LD-3).

Using the lithographic printing plate thus-prepared, printing was conducted in the same manner as in Example 9. More than 50,000 good prints similar to those in Example 9 were obtained wherein a highly accurate image was reproduced substantially same as one on the printing plate and background stain was not recognized at all in the non-image portion.

While the invention has been described in detail and with reference to specific embodiments thereof, it will be apparent to one skilled in the art that various changes and modifications can be made therein without departing from the spirit and scope thereof.

What is claimed is:

1. A method for preparation of a waterless lithographic printing plate by an electrophotographic process comprising forming a non-fixing toner image on a surface of an electrophotographic light-sensitive element comprising an electrically conductive support having provided thereon a photoconductive layer by an electrophotographic process, providing a non-tacky resin layer having adhesion to the surface of electrophotographic light-sensitive element larger than adhesion between the toner image and the surface of electrophotographic light-sensitive element on the whole surface of electrophotographic light-sensitive element bearing the toner image, and selectively removing the non-tacky resin layer provided on the toner image wherein the toner image is not fixed.

2. A method for preparation of waterless lithographic printing plate by an electrophotographic process as claimed in claim 1, wherein a difference between a force necessary for releasing the non-tacky resin layer from the surface of electrophotographic light-sensitive element in the non-image portion and a force necessary for removing the non-tacky resin layer from the surface of electrophotographic light-sensitive layer in the image portion is not less than 180 gram.force.

3. A method for preparation of waterless lithographic printing plate by an electrophotographic process as claimed in claim 1, wherein a force necessary for releasing the non-tacky resin layer from the surface of electrophotographic light-sensitive element in the non-image portion is not less than 200 gram.force and a force necessary for removing the non-tacky resin layer from the surface of electrophotographic light-sensitive element in the image portion is not more than 20 gram.force.

4. A method for preparation of waterless lithographic printing plate by an electrophotographic process as claimed in claim 1, wherein a surface of the non-tacky resin layer has a surface energy of not more than 30 $erg.cm^{-1}$.

5. A method for preparation of waterless lithographic printing plate by an electrophotographic process as claimed in claim 4, wherein the non-tacky resin layer contains a silicone resin.

6. A method for preparation of waterless lithographic printing plate by an electrophotographic process as claimed in claim 5, wherein the silicone resin is a polymer composed of an organo siloxane repeating unit represented by the following general formula (I):

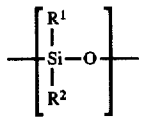

(I)

wherein $R^1$ and $R^2$, which may be the same or different, each represents an aliphatic or aromatic hydrocarbon group or a heterocyclic group.

7. A method for preparation of waterless lithographic printing plate by an electrophotographic process as claimed in claim 4, wherein the non-tacky resin layer contains a fluorinated resin.

8. A method for preparation of waterless lithographic printing plate by an electrophotographic process as claimed in claim 1, wherein the non-tacky resin layer is cured.

9. A method for preparation of waterless lithographic printing plate by an electrophotographic process as claimed in claim 1, wherein a chemical bond is formed at the interface between the electrophotographic light-sensitive element and the non-tacky resin layer in the non-image portion.

10. A method for preparation of waterless lithographic printing plate by an electrophotographic process as claimed in claim 1, wherein the electrophotographic process for forming the toner image comprises scanning exposure using a laser beam based on a digital information and development using a liquid developer.

11. A method for preparation of waterless lithographic printing plate by an electrophotographic process as claimed in claim 1, wherein the selective removal of the non-tacky resin layer in the image portion is conducted by a dry process.

* * * * *